US008004406B2

(12) United States Patent
Bleckmann et al.

(10) Patent No.: US 8,004,406 B2
(45) **Date of Patent: *Aug. 23, 2011**

(54) PLIABLE MATERIAL TAG USING A LANYARD OR A PORTION OF A GARMENT

(76) Inventors: Frederick A. Bleckmann, Barrington, NH (US); James Brodzik, Somerdale, NJ (US); Seth Strauser, Sewell, NJ (US); Gary Mazoki, Sewell, NJ (US)

( * ) Notice: Subject to any disclaimer, the term of this patent is extended or adjusted under 35 U.S.C. 154(b) by 281 days.

This patent is subject to a terminal disclaimer.

(21) Appl. No.: 12/328,389

(22) Filed: Dec. 4, 2008

(65) Prior Publication Data

US 2009/0135014 A1 May 28, 2009

Related U.S. Application Data

(63) Continuation-in-part of application No. 12/264,640, filed on Nov. 4, 2008.

(60) Provisional application No. 61/012,222, filed on Dec. 7, 2007, provisional application No. 60/985,695, filed on Nov. 6, 2007.

(51) Int. Cl.
*G08B 13/12* (2006.01)

(52) U.S. Cl. ..... 340/568.1; 340/571; 340/572.1; 340/572.8

(58) Field of Classification Search ..... 340/568.1, 340/568.2, 568.4, 571, 572.1, 572.8
See application file for complete search history.

(56) References Cited

U.S. PATENT DOCUMENTS

| | | | | |
|---|---|---|---|---|
| 3,270,453 | A | 9/1966 | Mitchell | |
| 3,777,378 | A | 12/1973 | Sant'Anselmo | |
| 5,309,740 | A * | 5/1994 | Hansen | 70/57.1 |
| 5,508,684 | A | 4/1996 | Becker | |
| 5,583,489 | A | 12/1996 | Loemker et al. | |
| 5,945,909 | A | 8/1999 | Kolton | |
| 6,052,876 | A | 4/2000 | Hogan et al. | |
| 6,188,320 | B1 * | 2/2001 | Kolton et al. | 340/572.9 |
| 6,254,953 | B1 * | 7/2001 | Elston | 428/40.1 |

(Continued)

FOREIGN PATENT DOCUMENTS

DE 20316078 2/2004

(Continued)

OTHER PUBLICATIONS

International Search Report for corresponding PCT Application No. PCT/US2008/085553 dated Sep. 15, 2009.

*Primary Examiner* — Toan N Pham
(74) *Attorney, Agent, or Firm* — Caesar, Rivise, Bernstein, Cohen & Pokotilow, Ltd.

(57) ABSTRACT

A security tag that can be attached to an item or items that provides a zero or low impact to the item or items such as elegant or soft goods. The security tag includes a security element that is enclosed within a pliable material that is coupled to the item or items it is protecting by either a lanyard or by passing a portion of the unfinished garment through aperture(s) in the pliable material. The lanyard can take on various compositions and can couple to the pliable material using different latching mechanisms. No puncturing, piercing or adhesive attachment to the elegant or soft goods occurs, thereby making a "zero or low impact" on the item while also making a pleasant presentation to customers when the item (or items) is displayed.

52 Claims, 13 Drawing Sheets

U.S. PATENT DOCUMENTS

| | | | | |
|---|---|---|---|---|
| 6,367,426 | B1 | 4/2002 | Schaible | |
| 6,432,235 | B1 | 8/2002 | Bleckmann et al. | |
| 6,433,686 | B1 | 8/2002 | Feibelman | |
| 6,550,813 | B1 | 4/2003 | Siegrist | |
| 6,671,987 | B1 | 1/2004 | Fenton | |
| 6,724,311 | B1 * | 4/2004 | Kolton et al. | 340/572.8 |
| 6,780,265 | B2 | 8/2004 | Bleckmann et al. | |
| 6,827,817 | B2 | 12/2004 | Bleckmann et al. | |
| 6,836,215 | B1 | 12/2004 | Laurash et al. | |
| 7,536,884 | B2 * | 5/2009 | Ho | 70/57.1 |
| 2002/0154014 | A1 | 10/2002 | Elston | |
| 2005/0000134 | A1 | 1/2005 | Davis et al. | |
| 2006/0255952 | A1 | 11/2006 | Waegner | |

FOREIGN PATENT DOCUMENTS

| | | |
|---|---|---|
| EP | 0595549 | 5/1994 |
| EP | 0692774 | 1/1996 |
| EP | 1054369 | 11/2000 |
| EP | 1388827 | 2/2004 |
| EP | 1171300 | 11/2005 |
| EP | 1390926 | 4/2007 |
| FR | 2804303 | 8/2001 |
| GB | 201691 | 8/1923 |
| GB | 198989 | 5/1924 |
| WO | 98/24075 | 6/1998 |
| WO | 2005/043494 | 5/2005 |

* cited by examiner

FIG. 3
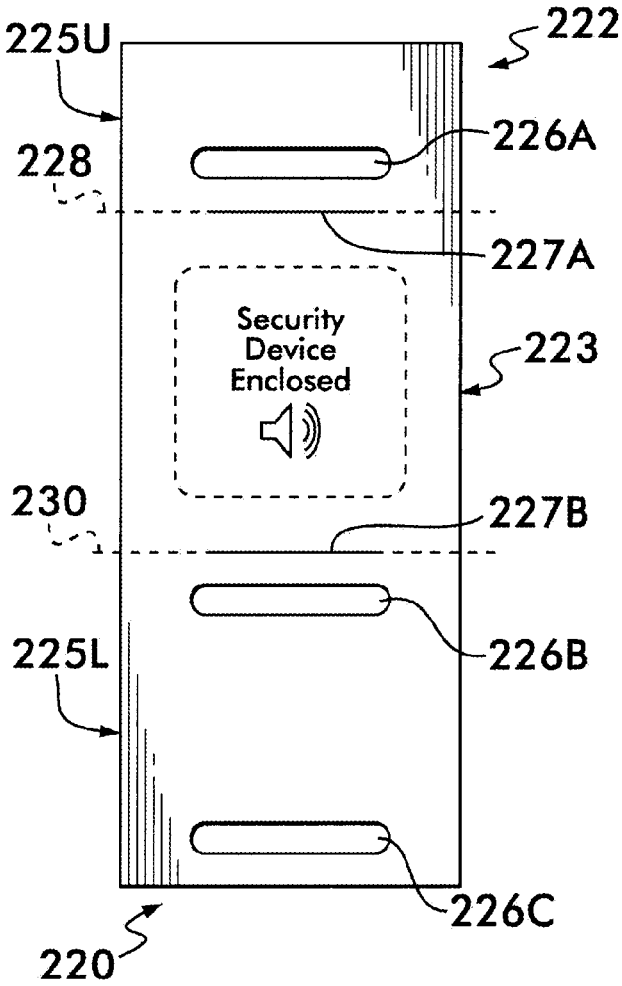
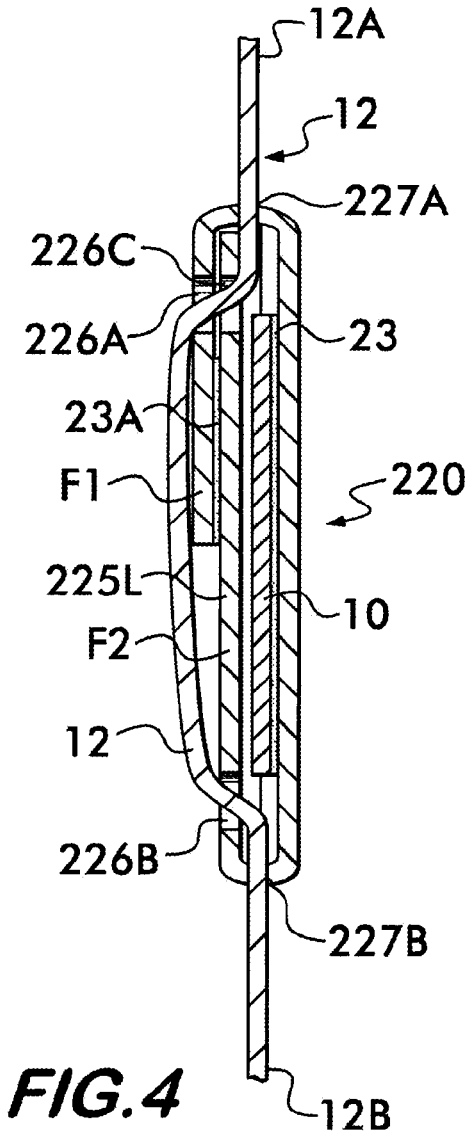
FIG. 4

FIG.15
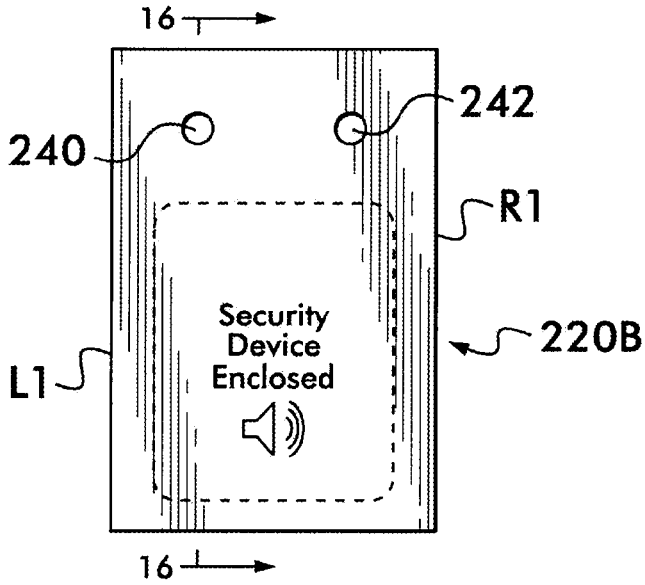
FIG.16
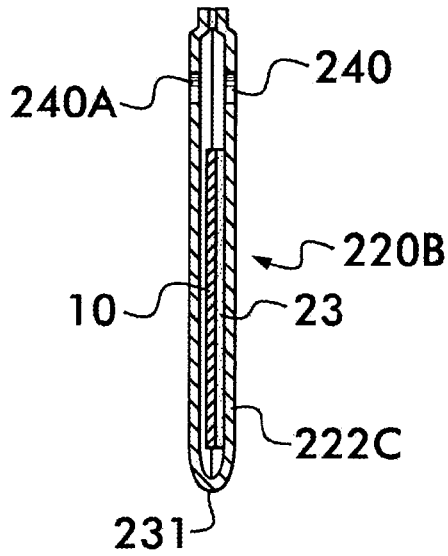
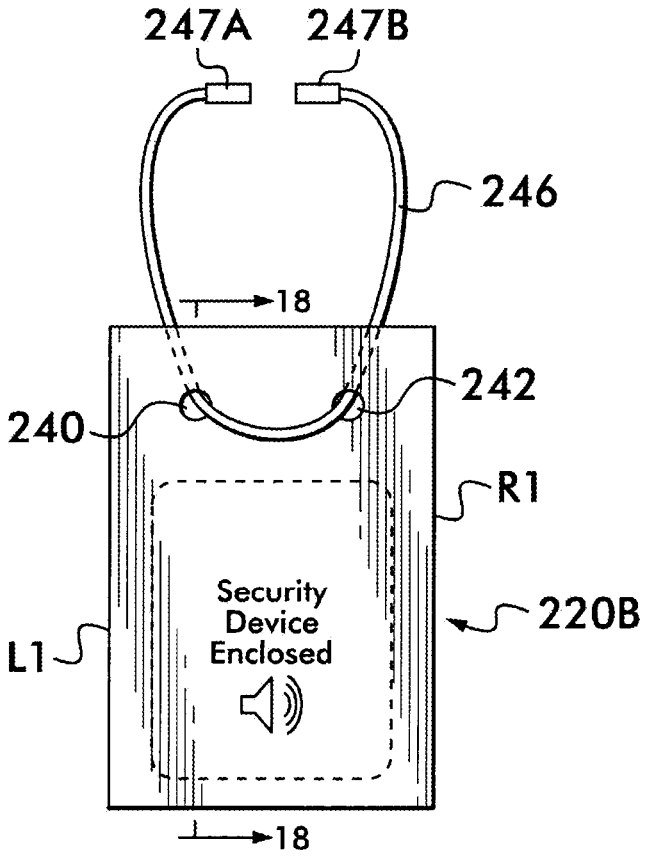
FIG.17
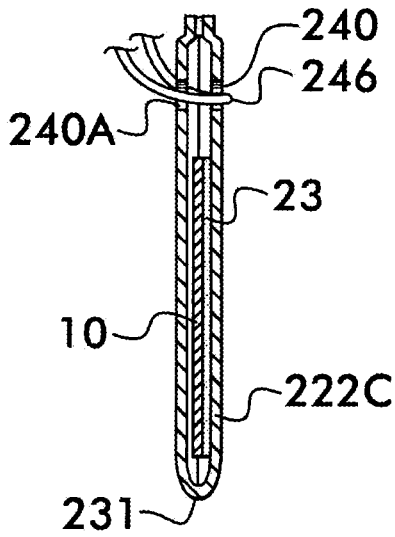
FIG.18

FIG.19
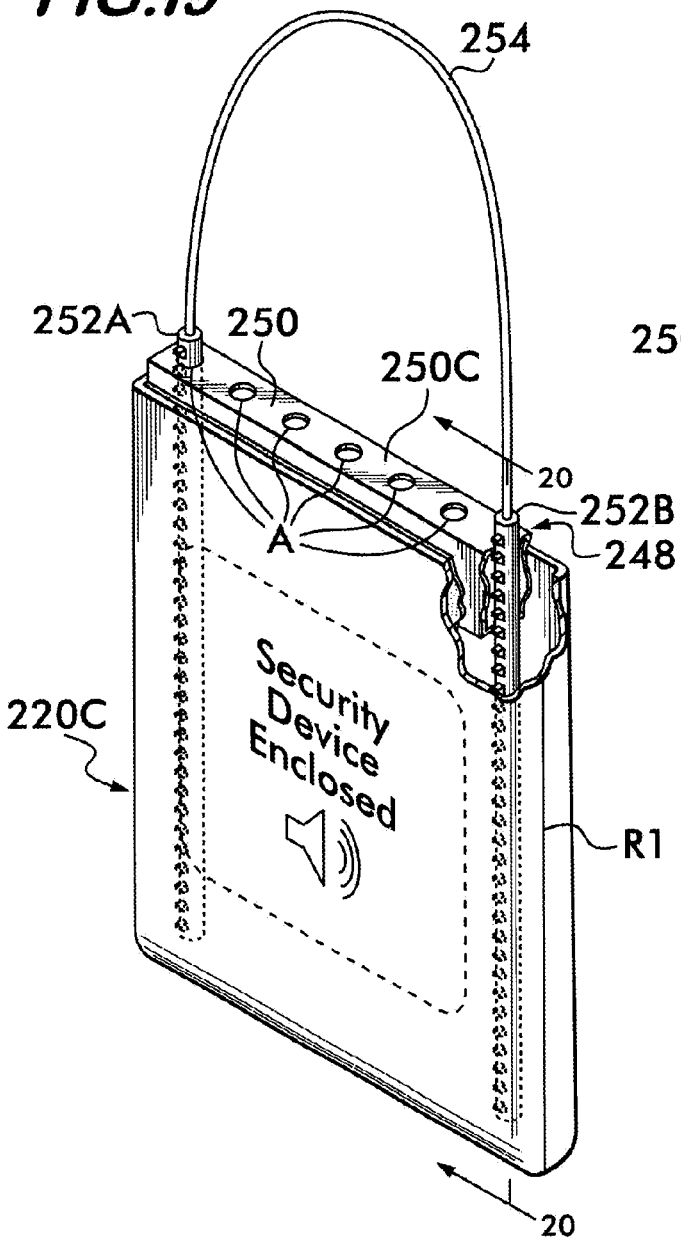
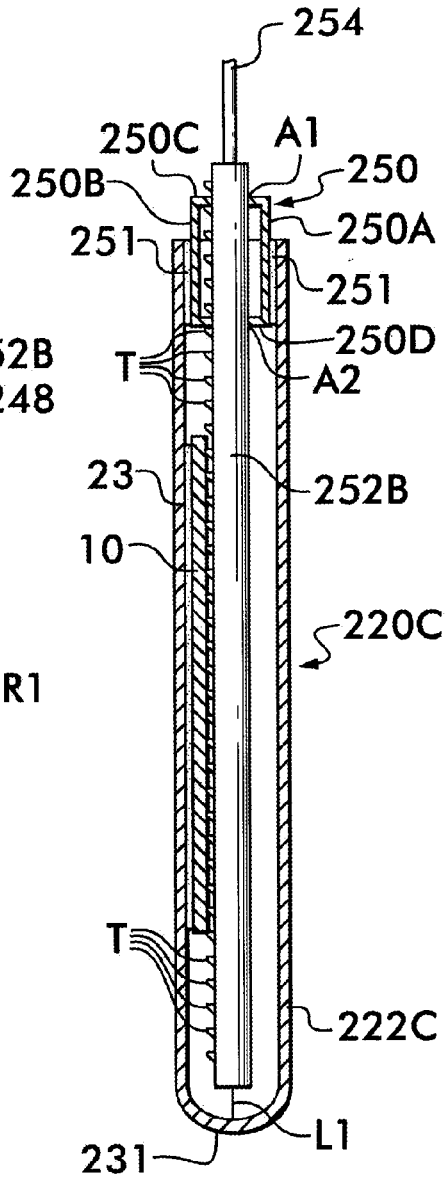
FIG.20

FIG.24
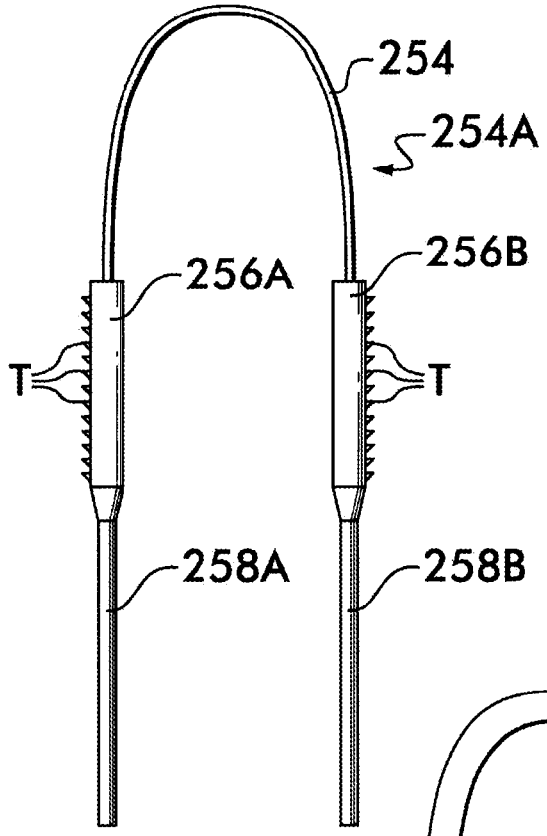
FIG.25
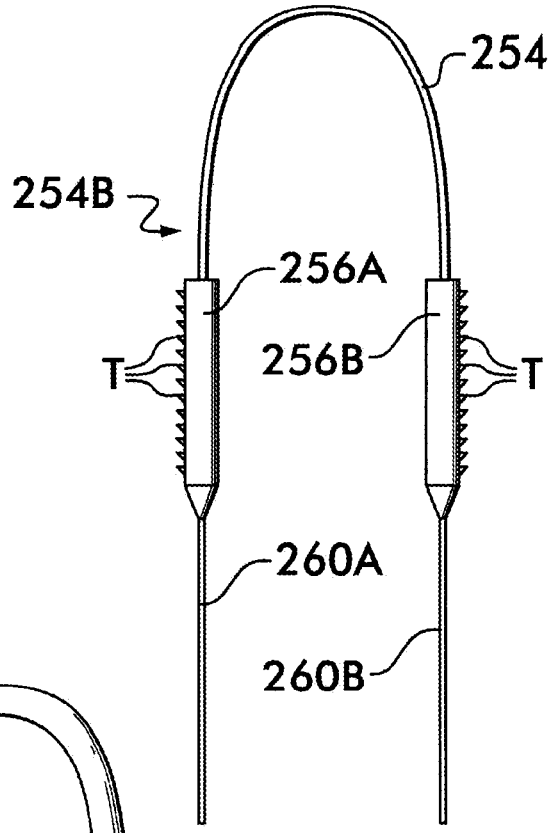
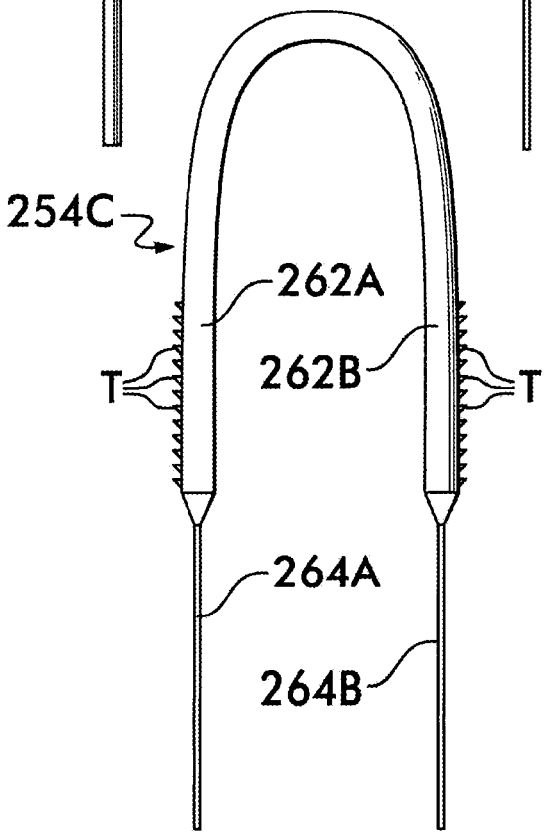
FIG.26

FIG. 33
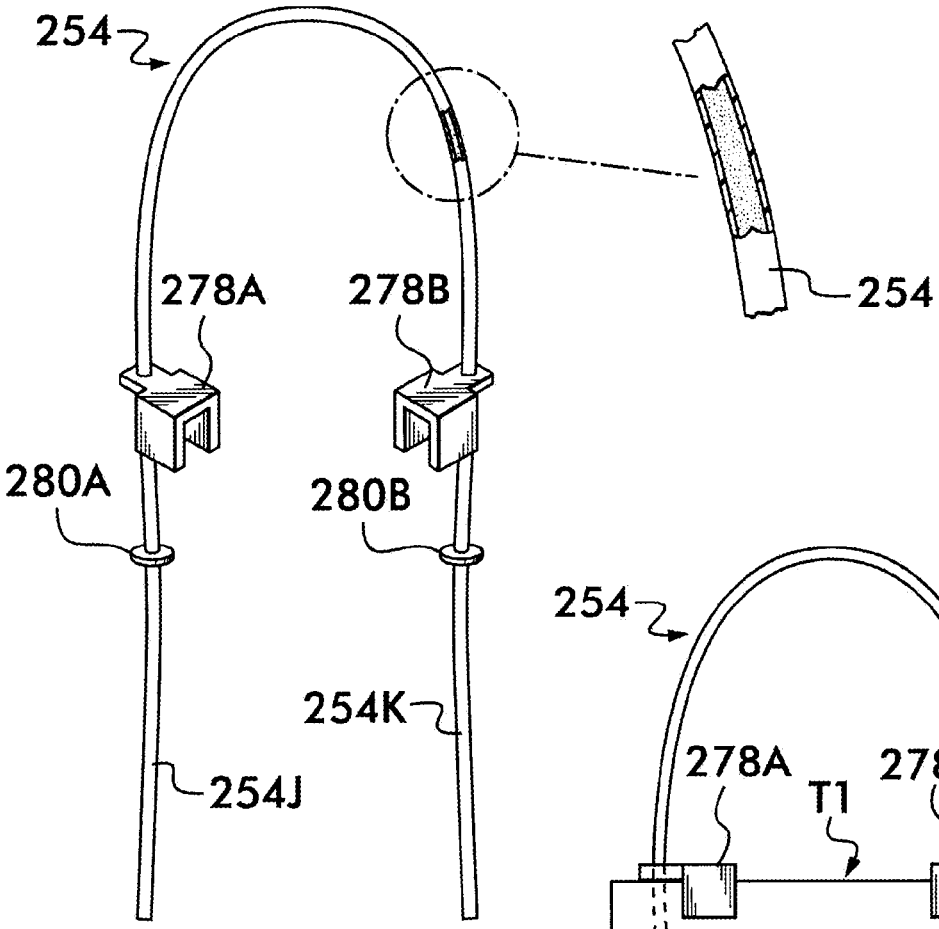
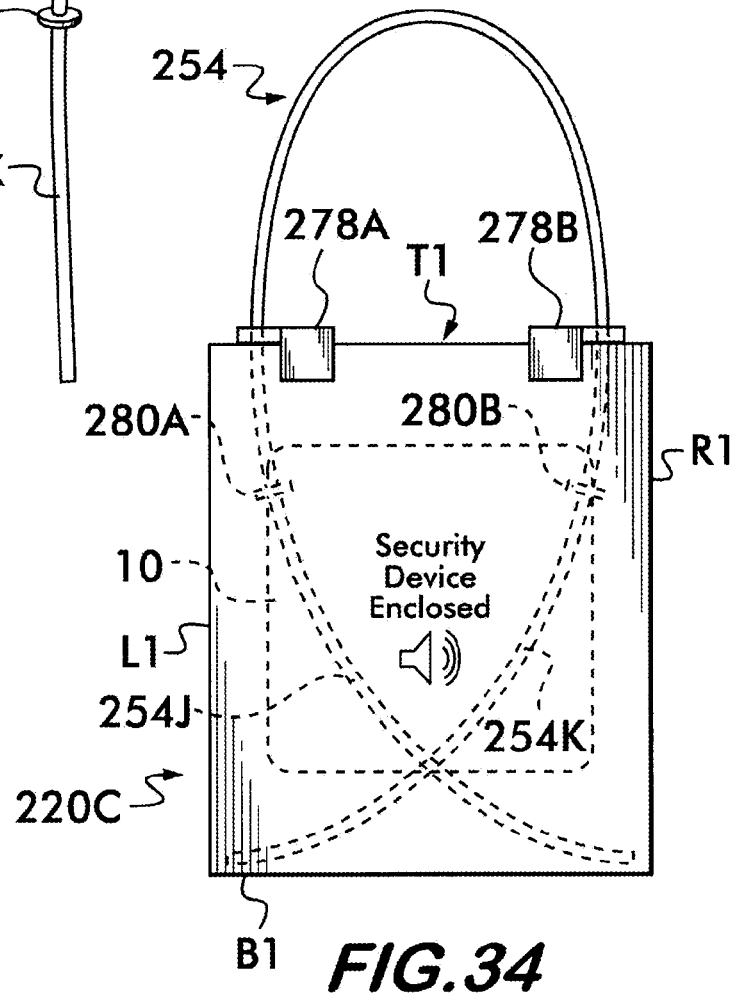
FIG. 34

PLIABLE MATERIAL TAG USING A LANYARD OR A PORTION OF A GARMENT

CROSS-REFERENCE TO RELATED APPLICATIONS

This application claims the benefit under 35 U.S.C. §119 (e) of Provisional Application Ser. No. 61/012,222 filed on Dec. 7, 2007, entitled PLIABLE MATERIAL TAG USING A LANYARD OR A PORTION OF A GARMENT and whose entire disclosure is incorporated by reference herein. This application is also a continuation-in-part application and claims the benefit under 35 U.S.C. §120 of application Ser. No. 12/264,640 filed on Nov. 4, 2008, entitled PLIABLE MATERIAL LOOP TAG which in turn claims the benefit under 35 U.S.C. §119(e) of Provisional Application Ser. No. 60/985,695 filed on Nov. 6, 2007, entitled PLIABLE MATERIAL LOOP TAG and both of whose entire disclosures are also incorporated by reference herein.

BACKGROUND OF THE INVENTION

1. Field of the Invention

The present invention relates to security tags and more particularly, discloses pliable material tags using a lanyard or a portion of a garment for attachment to elegant or soft goods.

2. Description of Related Art

Many apparel items can be tagged (i.e., a security device or element applied) at the source using these existing product and methods. These security devices may comprise electronic article surveillance (EAS) elements, radio frequency identification (RFID) elements or combinations of such security devices, etc., and which can be wirelessly detected at business portals, e.g., store exits or points of sale (POS), etc. to prevent or diminish theft from the business. The actual tagging of the security device/element to the apparel "impacts" the apparel by either puncturing the apparel (e.g., pin and receptacle) or by being adhesively secured to the apparel, or being embedded (e.g., sewn) within the apparel. Not only does this create an undesirable effect (e.g., a puncture hole, a distortion, etc., in the apparel material) but it also disturbs the presentation of the apparel when displayed in the business. For example, the attachment of the security device/element to the apparel may distort or wrinkle the fabric when the apparel is positioned on the hanger, the mannequin, or other display methods. Such an uninviting display actually discourages patrons from even considering trying on the apparel, thereby losing a potential sale.

This is most apparent in many apparel items such as intimates, bathing suits and accessories but also occurs with soft goods. Soft goods include homeware items such as bedding, towels, fabrics, etc. Thus, these types of goods do not favor the known security devices and methods for attaching such devices due to the size of the goods or the invasive nature of the products known in the art. The attachment of a security device embedded in packaging for apparel, linens and soft goods is known in the art. A woven label such as that shown in U.S. Pat. No. 6,780,265 (Bleckmann, et al.) has an embedded EAS or RFID device.

The method of attaching such a woven label by a sewing machine is also known in the art. Other methods are disclosed where the device is embedded within a paper ticket, price tag or hang tag (swing ticket). These products are also attached by known methods. By way of example, see U.S. Pat. Nos. 5,508,684 (Becker); 5,583,489 (Loemaker, et al.); 6,254,953 (Elston); and EP 1171300 (Bleckmann, et al.).

Moreover, where RFID security devices are used, many people have an apprehension with such devices when they are used in connection with personal items because it harbors connotations of invasion of privacy. RFID security devices typically include a memory regarding the item itself. Where such security devices are sewn into apparel, people are reluctant to purchase apparel that may permanently contain a device that may store information and which cannot be removed without damaging the apparel. Thus, the use of RFID security devices tend to increase the "impact" of such security devices on apparel.

Thus, in view of the foregoing, there remains a need for providing a security tag that can be secured to elegant items or soft goods without having to pierce, puncture or adhesively attach to such items and that minimize invasion of privacy concerns for customers, i.e., that provide a "zero or low impact" to such items.

All references cited herein are incorporated herein by reference in their entireties.

BRIEF SUMMARY OF THE INVENTION

The present invention provides a product and method for easily attaching a pliable non-invasive package embedded with at least one security element.

The present invention relates to a package into which the security element is embedded. The invention also relates to a tool for efficient and reliable attachment to an apparel item.

A security tag for coupling to an item (e.g., elegant or soft goods) wherein the security tag comprises: at least one security element (e.g., an EAS or RFID security element or any combination thereof in any frequency range or ranges) that responds to a magnetic or electromagnetic field of a particular frequency or frequencies; and a pliable material (e.g., a woven fabric, plastic, other non-conductive pliable materials, etc.) in which the security element is enclosed and wherein the pliable material (e.g., which may comprise a multi-folded configuration, a single fold, or may comprise a two-layer configuration, etc.) comprises at least one aperture, wherein the at least aperture receives a portion of the item during item assembly, or receives a lanyard, for coupling to the item.

A security tag for coupling to an item (e.g., elegant or soft goods) wherein the security tag comprises: at least one security element (e.g., an EAS or RFID security element or any combination thereof in any frequency range or ranges) that responds to a magnetic or an electromagnetic field of a particular frequency or frequencies; a pliable material (e.g., a woven fabric, plastic, other non-conductive pliable materials, etc.) in which said security element is enclosed; and a lanyard comprising a pair of ends at least one of which secures to at least one edge of said pliable material (e.g., which may comprise a single fold, or may comprise a two-layer configuration, etc.).

A security tag for coupling to an item (e.g., elegant or soft goods) wherein the security tag comprises: at least one security element (e.g., an EAS or RFID security element or any combination thereof in any frequency range or ranges) that responds to a magnetic or an electromagnetic field of a particular frequency or frequencies; a pliable material (e.g., a woven fabric, plastic, other non-conductive pliable materials, etc.) in which the security element is enclosed; and a lanyard, filled with a colorant (e.g., ink, dye, any substance that leaves a colored mark when released from the tube, etc.), having ends that are enclosed within the pliable material, and wherein the lanyard is coupled to the pliable material.

A method for coupling a security label to an item (e.g., elegant or soft goods) without piercing or adhering the security label to the item and wherein the method comprises: enclosing a security element (e.g., an EAS or RFID security element or any combination thereof in any frequency range or ranges) within a pliable material (e.g., a woven fabric, plastic, other non-conductive pliable materials, etc.) and wherein the security element is responsive to a magnetic or an electromagnetic field of a particular frequency or frequencies; providing at least one aperture within the pliable material; feeding a portion of the item through the at least one aperture during assembly of the item; and completing the item by securing the portion to the item.

A method of attaching a security label to an item (e.g., elegant or soft goods) without piercing or adhering the security label to the item and wherein the method comprises: enclosing a security element (e.g., an EAS or RFID security element or any combination thereof in any frequency range or ranges) within a pliable material (e.g., a woven fabric, plastic, other non-conductive pliable materials, etc.) and wherein the security element is responsive to a magnetic or an electromagnetic field of a particular frequency or frequencies; providing at least one aperture within the pliable material; passing one end of a lanyard through the at least one aperture; and securing the one end of the lanyard to another end of the lanyard to couple the security label to the item.

A method of attaching a security label to an item (e.g., elegant or soft goods) without piercing or adhering the security label to the item and wherein the method comprises: enclosing a security element (e.g., an EAS or RFID security element or any combination thereof in any frequency range or ranges) within a pliable material (e.g., a woven fabric, plastic, other non-conductive pliable materials, etc.) and wherein the security element is responsive to a magnetic or an electromagnetic field of a particular frequency or frequencies; fixedly securing a lanyard coupling along an edge of the pliable material; looping a lanyard around a portion of the item; and fixedly securing ends of the lanyard within the lanyard coupling.

A method for coupling a security label to an item (e.g., elegant or soft goods) without piercing or adhering said security label to the item, said method comprises: enclosing a security element within a pliable material (e.g., a woven fabric, plastic, other non-conductive pliable materials, etc.), wherein the security element (e.g., an EAS or RFID security element or any combination thereof in any frequency range or ranges) is responsive to a magnetic or an electromagnetic field of a particular frequency or frequencies; fixedly securing a lanyard coupling along an edge of the pliable material; looping a lanyard around a portion of the item; and fixedly securing a first end of the lanyard within the lanyard coupling and securing a second end of the lanyard to the lanyard.

A method of attaching a security label to an item (e.g., elegant or soft goods) without piercing or adhering the security label to the item and wherein the method comprises: enclosing a security element (e.g., an EAS or RFID security element or any combination thereof in any frequency range or ranges) within a pliable material (e.g., a woven fabric, plastic, other non-conductive pliable materials, etc.) and wherein the security element is responsive to a magnetic or an electromagnetic field of a particular frequency or frequencies; looping a lanyard around a portion of the item; and fixedly securing ends of the lanyard to an edge of the pliable material.

A method for coupling a security label to an item (e.g., elegant or soft goods) without piercing or adhering the security label to the item, and wherein the security tag comprises: enclosing a security element within a pliable material (e.g., a woven fabric, plastic, other non-conductive pliable materials, etc.), and wherein the security element (e.g., an EAS or RFID security element or any combination thereof in any frequency range or ranges) is responsive to a magnetic or an electromagnetic field of a particular frequency or frequencies; providing a lanyard, filled with a colorant (e.g., ink, dye, any substance that leaves a colored mark when released from the tube, etc.), and disposing ends of the lanyard within the pliable material; and securing the lanyard to the pliable material.

BRIEF DESCRIPTION OF SEVERAL VIEWS OF THE DRAWINGS

The invention will be described in conjunction with the following drawings in which like reference numerals designate like elements and wherein:

FIG. 3 is an unfolded presentation of the security tag or label of the present invention showing the apertures formed therein;

FIG. 4 is a cross-sectional view of the present invention taken along line 4-4 of FIG. 1;

FIG. 15 is also a plan view of the third security tag/label having a pair of horizontally-adjacent apertures;

FIG. 16 is a side cross-sectional view of the third security tag/label of FIG. 15;

FIG. 17 depicts a lanyard including a clear plastic tube which is filled with a colorant (e.g., ink, dye, etc.) to deter tampering and passed through the third security tag/label;

FIG. 18 is a side cross-sectional view of the third security tag/label of FIG. 17;

FIG. 19 is an enlarged isometric view, shown partially broken, of the second or third security tag/label using a male/female coupling for fixedly securing a lanyard/tether to either security tag/label;

FIG. 20 is an enlarged cross-sectional view of the security tag/label taken along line 20-20 of FIG. 19;

FIG. 24 is a plan view of an alternative lanyard/tether for use with the coupling of FIGS. 19-21;

FIG. 25 is a plan view of another alternative lanyard/tether for use with the coupling of FIGS. 19-21;

FIG. 26 is a plan view of a further alternative lanyard/tether comprising an integral one piece design for use with the coupling of FIGS. 19-21;

FIG. 33 depicts an colorant-filled lanyard having respective latches coupled to respective sections of the lanyard; and FIG. 34 depicts how the lanyard of FIG. 33 is coupled to, and lanyard end portions that are concealed within, the security label.

DETAILED DESCRIPTION OF THE INVENTION

Figure 1:
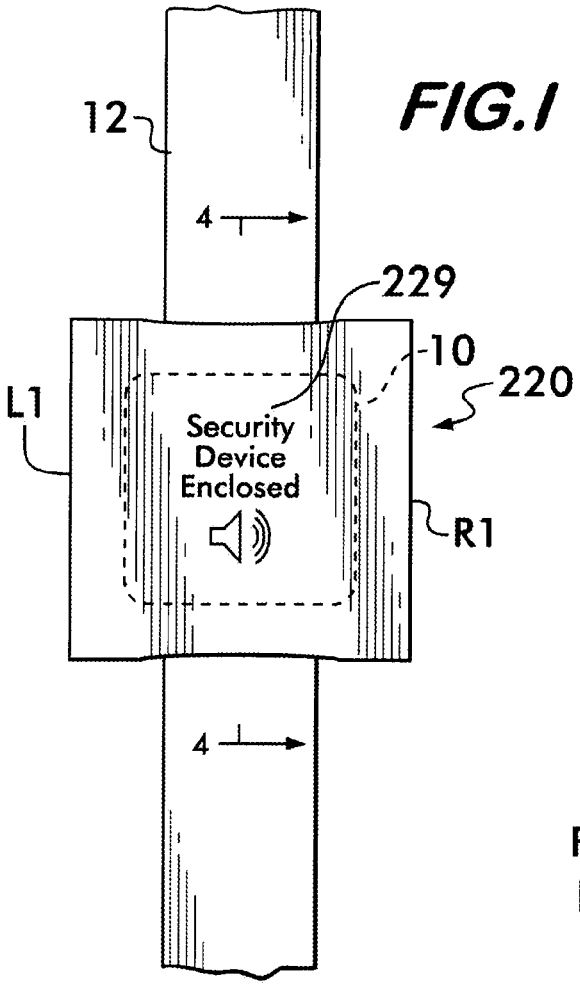
FIG. 1 is a plan view of the front side of a security tag or label of the present invention showing a security element concealed within a pliable material or carrier and which is coupled to an unfinished portion (e.g., a belt loop, brassiere strap, etc.) of a soft good or garment.
Figure 2:
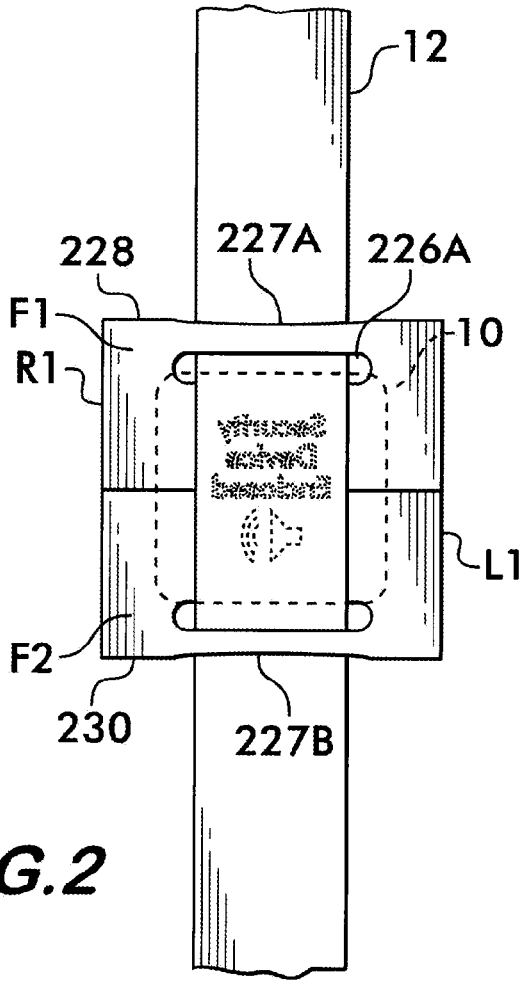
FIG. 2 is a plan view of the back side of the security tag or label of the present invention of FIG. 1 shown coupled to an unfinished portion of a soft good or garment portion.

The present invention provides a product and method for attaching a radio frequency (RF), acousto-magnetic (AM), electromagnetic (EM) or other transmitting and/or receiving device, circuit, coil, microchip, antenna, EAS device, RFID device, or any combination thereof (hereinafter referred to as a "security element" or "security tag") to an item (or items); the preferred items to which the present invention is attached are apparel or soft goods products, although this is by way of example only and not by way of limitation. Thus, the term "garment" as used throughout this Specification is used in its broadest sense to encompass this broad category of apparel or soft good products. It should be further noted that the frequency range of the operation of the security element or tag presents no limitation to the present invention and that operation of a security element in the kHz range (or lower) or operation in the microwave or GHz range (or higher) is within the broadest scope of the present invention. Therefore, whenever the security tag/label is subjected to an interrogation field (e.g., pedestals at a store exit, RFID reader at the point-of-sale (POS), or any other reader/interrogation configuration and location) of the particular frequency or frequencies, the security element portion responds.

The principle of the present invention is to couple a security element to a pliable material (also referred to as a "carrier") which is then folded, or has portions that are then folded over each other, or whereby another layer of pliable material is placed against the other pliable material to "sandwich" the security element therebetween. The end result is a "security tag" or "security label" for use with apparel or soft good products. Apertures formed in these configurations permit the passage of a portion (e.g., belt loop, brassiere strap, etc.) of the soft goods (hereinafter "garment") through the carrier, prior to the garment's completion during assembly; once passed through the carrier, the portion of the garment is then permanently attached to the garment as normal, thereby securing the present invention, including the security element, to the garment. Alternatively, a lanyard or tether may be passed through the apertures for securing the carrier to the garment. Other variations of the present invention do not involve including slots or slits in the carrier but rather that the use of couplings associated with the carrier and lanyards that permit the invention of the present application to be coupled to the garment.

It should be understood that the pliable material may comprise a wide range of materials that are pliable such as, but not limited to, fabric (e.g., woven materials, etc.) or plastic, etc. The construction of a security element within a pliable material is disclosed in U.S. application Ser. No. 12/264,640 entitled "Pliable Material Loop Tag" filed on Nov. 4, 2008, as well as U.S. Pat. No. 6,780,265 (Bleckmann, et al.), both of whose entire disclosures are incorporated by reference herein. The edges of the carrier are sealed and bonded with the security element 10 inside. As mentioned in these documents, the sealing can be, by way of example only, ultrasonic stitching.

As shown in FIGS. 1-4, the security label 220 of the present invention relates to a carrier for an anti-theft or electronic article surveillance (EAS) device or radio frequency (RF), or radio frequency identification (RFID) item tracking device, hereinafter referred to as a security element 10.

Figure 6:
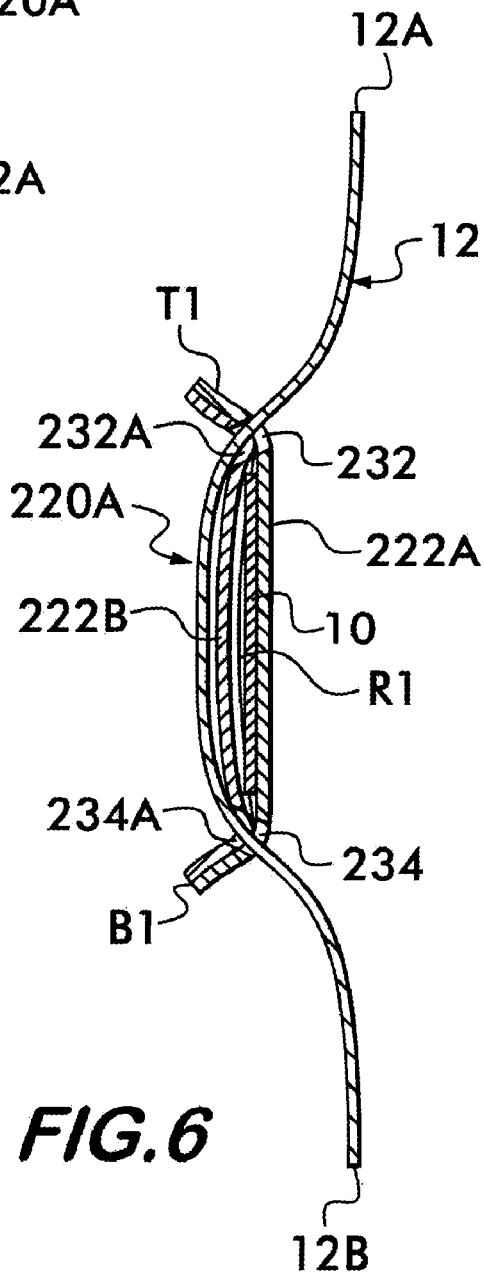
FIG. 6 is a side cross-sectional view of the security tag or label of FIG. 5.

As can be seen in FIGS. 3-4, the security label 220 comprises a pliable material (e.g., a woven fabric, a plastic material, etc.) or carrier 222 in which a security element 10 (e.g., an EAS security element, RFID security element, a combination of security elements or tags, etc.) is concealed, e.g., via an adhesive 23 (FIG. 4), or ultrasonic bonding, or simply free-floating (see FIG. 6). This material or carrier 222 comprises a non-conductive material. In particular, with the security element 10 positioned against a central portion 223 the pliable material 222 (and either adhesively-secured or free-floating), an upper portion 225U of the pliable material 222 and a lower portion 225L of the pliable material 222 are folded around the security element 10 to form respective folds F1 and F2 that overlap (see FIG. 2). These folds are heated and pressed which applies a memory to the pliable material 222 at the folds F1 and F2 such that they do not come apart, thereby concealing the security element 10 therein; alternatively, an adhesive 23A (FIG. 4) can be applied at the overlap of folds F1 and F2. In addition, the sides of the pliable material or carrier 222 are bonded to form closed left L1 and right edges R1 (FIGS. 1 and 2), thereby enclosing the security element 10 within the pliable material 222. It should be noted that the bonding of the sides L1 and R1 may take before the folds F1 and F2 are formed or after.

As shown most clearly in FIG. 3, the carrier or pliable material 222 is shown in its original state, i.e., before it is folded. The pliable material or carrier 222 includes apertures, e.g., slots 226A-226C and slits 227A-227B for receiving a portion 12 of a garment (e.g., belt loop, brassiere strap, etc.) prior to the garment's completion during assembly. The arrangement of the slots 226A-226C and the slits 227A-227B are such that when the pliable material or carrier 222 is folded to enclose the security element 10 therein, these apertures permit a free end of the portion 12 to be passed therethrough, thereby coupling the security label 220 to the portion 12 of the garment and then fixedly securing the free end of the portion 12 to the garment (not shown). In particular, the upper portion 225U comprises at least one slot 226A and a slit 227A positioned along a fold line 228. The lower portion 225L comprises at least two slots 226A and 226B and a slit 227B positioned along another fold line 230. Thus, when the upper portion 225U and the lower portion 225L are folded along their respective fold lines 228 and 230, the result, as shown most clearly in FIG. 4, is that slots 226A and 226C align when folds F1 and F2 are formed. In this configuration and as shown most clearly in FIG. 4, a free end (12A or 12B) of the garment portion 12 (e.g., a belt loop) is passed through the apertures. For example, free end 12A can be first inserted through the slit 227B in fold line 230, passed through slot 226B in fold F2 and then inserted into aligned slots 226A and 226C in fold F1 and out through slit 227A in fold line 228. Similarly, free end 12B can be first inserted through slit 227A in fold line 228 and the process reversed.

It should be understood that after the folds F1 and F2 are formed and prior to inserting the portion 12 through the apertures, the sides of the carrier or pliable material 222 are closed. In particular, the sides of the pliable material or carrier 222 are bonded to form closed left L1 and right edges R1, thereby enclosing the security element 10 within the carrier or pliable material 222. By way of example only, the upper portion 225U may comprise approximately 13 mm, the central portion 223 may comprise approximately 44 mm and the lower portion 225L may comprise approximately 43 mm in length while the overall width of the carrier or pliable material 222 may comprise 42 mm. Again, by way of example only, an even smaller version may comprise the following respective dimensions: 17 mm, 34 mm, 33 mm and 35 mm.

It should be understood that different configurations of apertures can be used and not just those shown in FIGS. 1-4. For example, the lower portion 225L may comprise only one slot while the upper portion 225U may comprise two slots. The key feature is that the folds and the fold lines comprise a plurality of slots and slits that permit the passage of the portion 12 therethrough.

By way of example only, the front side of the pliable material or carrier 222 opposite the folds F1 and F2 may comprise indicia 229 of various kinds, such as item-related indicia (e.g., price, size, etc.) and/or visual theft deterrent indicia (e.g., "security device enclosed") but not limited to only those types. For example, where RFID integrated circuits (ICs) are used as the security element 10, the indicia may include notification to the customer that an RFID IC is included therein, in case the customer wishes to remove the IC after purchase due to privacy concerns.

As can be appreciated from FIGS. 1-4, the construction of the security label 220, the position of the folds F1 and F2 and the slots of the corresponding folds are on one side (e.g., the back side, see FIG. 2) of the security label 220. Thus, as shown in FIG. 1, this results in a clear, undisturbed presentation of the label 220 and its indicia 229 with the garment (not shown).

Figure 31:
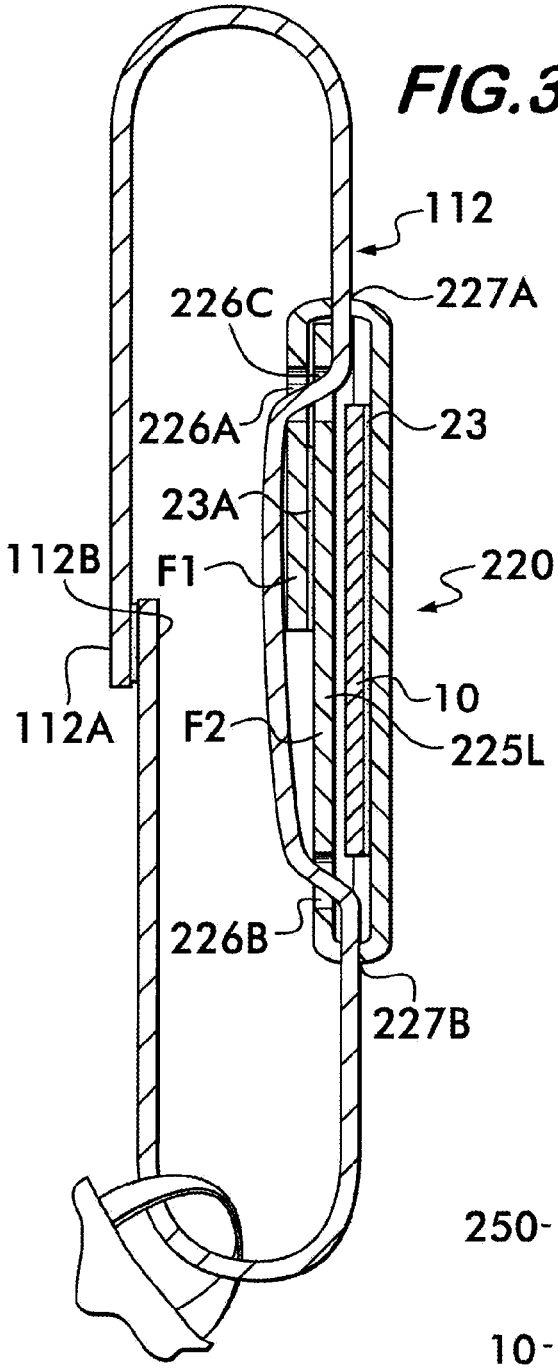
FIG. 31 is a cross-sectional view similar to FIG. 4 but showing a separate pliable material that is coupled to the security tag and whose ends are looped around a finished portion of a garment and closed on itself for coupling the security tag.

If the portion of the garment to which the security label 220 is to be coupled is already finished or closed (this being represented by the "garment loop" shown in FIG. 31), a lanyard or tether 112 of pliable material can be fed through the security label 220, through the finished portion of the garment (e.g., garment loop), and then the ends 112A and 112B of the lanyard or tether 112 can be fixedly secured together using any well-known securement mechanisms such as, but not limited to, sewing, hot crimping, adhesive, ultrasonics, riveting, etc.

Figure 5:
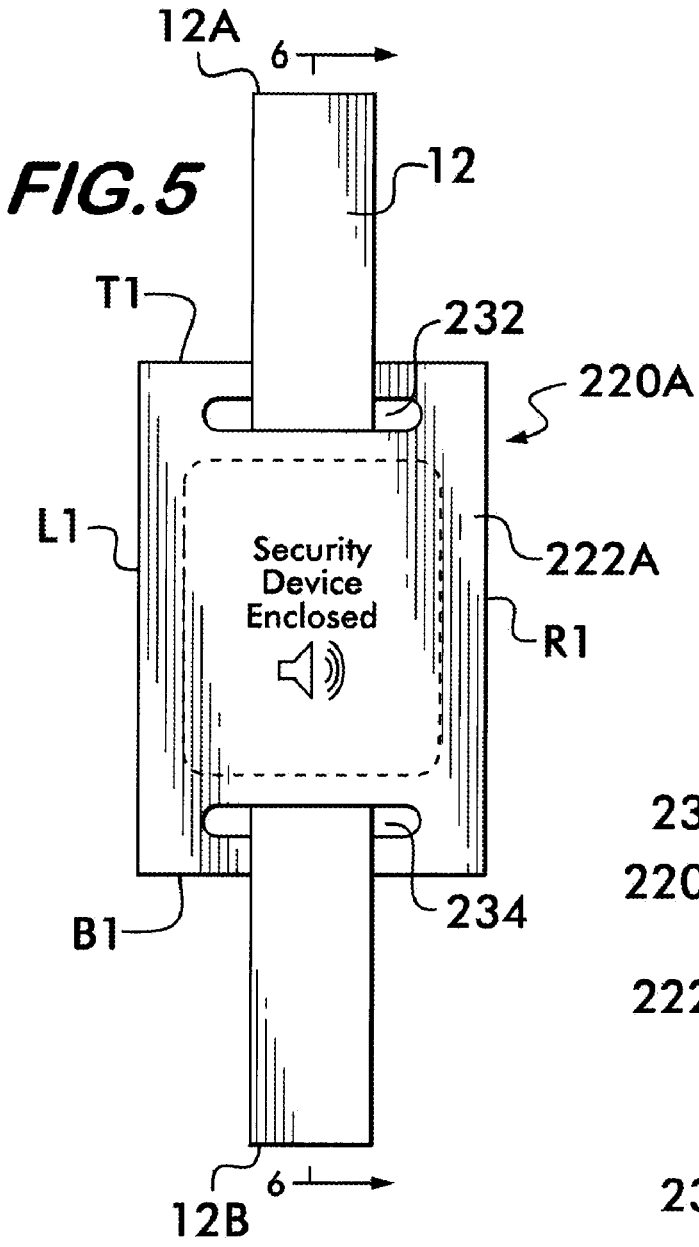
FIG. 5 depicts a plan view of a second security tag of the present invention showing the two layers of pliable material or carrier sandwiching the security element and having apertures through which passes an unfinished portion (e.g., a belt loop, a brassiere strap, etc.) of the garment.
Figure 7:
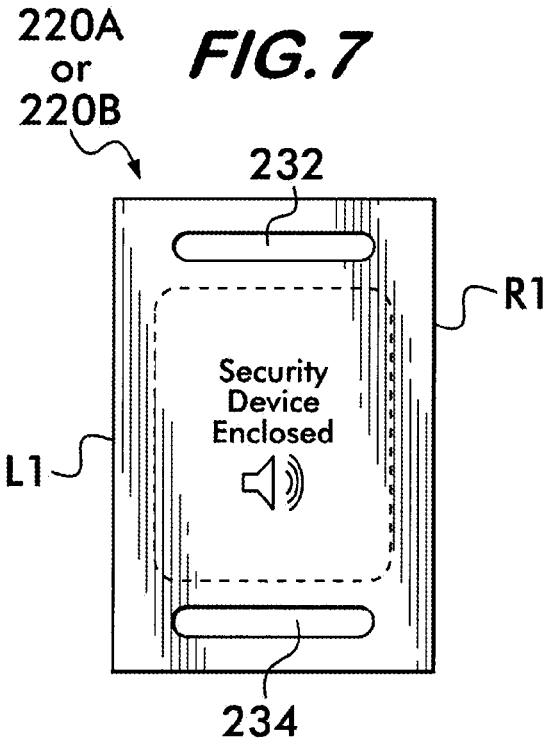
FIG. 7 is a plan view of the second security tag/label or the third security tag/label using a single aperture.

Another security label 220A (FIGS. 5-7) involves the use of two layers of pliable material 222A and 222B that are secured together to "sandwich" the security element 10 therebetween, as shown most clearly in FIG. 6. For example, materials 222A and 222B form respective front and back sides of the security label 220A which are secured together (e.g., bonded, by being sewn or by hot crimping, etc.) to enclose or conceal the security element 10 therein. Thus, the security label 220A also comprises apertures, e.g., slots 232 and 234 for receiving a portion 12 of a garment (e.g., belt loop, brassiere strap, etc.) prior to the garment's completion during assembly. Thus, for example, as shown in FIG. 5, the portion 12 may comprise a belt loop having one end 12B that is sewn to the pants' waste (not shown). However, the upper end 12A has not been sewn to the pants at this portion of the pants assembly. At this point, the security label 220A, having slots 232 and 234, is slid over the open upper end 12A of the belt loop as shown in FIG. 5. Next, in the pants assembly process, the upper end 12A is then sewn to the pants waste. FIG. 6 is a side cross-sectional view of the security label 220A slipped over the portion 12 and showing the security label 220A in cross section which also depicts the security element 10. The end result is that the security label 220A is secured to the pants during assembly. Another example is a strap for a dress that is sewn to the dress on two ends. Prior to the second end being sewn in place, the strap is looped through the security label 220A during the assembly of the dress. Once the invention 220A has been slid onto the strap, the strap is sewn in the second location, thereby completing the assembly of that portion of dress, while securing the security label 220A to the dress.

It should be noted that the slots 232 and 234 may be formed after the two layers 222A and 222B are secured together, or alternatively, the slots may be pre-formed in layer 222A which are then aligned with corresponding pre-formed slots 232A and 234A in layer 222B (see FIG. 6) and then the two layers 222A and 222B are secured together. Either of these aperture formations is within the broadest scope of the invention.

It should be understood that, as with the security label 220, upon a valid sale of the garment to which the security label 220A is attached, the security label 220A can be removed by store personnel at the point of sale (POS) by cutting the security label 220A using, for example, a scissors, to release it from the portion 12 of the garment. The only way for a thief to defeat this invention is to carry a tool (e.g., a scissors) that can be cut through the security label 220A.

The deterrent is that a thief is hesitant to carry a "tool" into a store or business to defeat the security labels 220 or 220A. As with the security label 220, the sides L1 and R1 of the security label 220A are closed (e.g., bonded). As with the side edges L1 and R1, the top edge T1 and bottom edge B1 are also closed by any well-known securement mechanisms such as, but not limited to, sewing, hot crimping, adhesive, ultrasonics, riveting, etc. It should be understood that the term "sewing" or "sewn" includes all manners and kinds of sewing.

Figure 8:
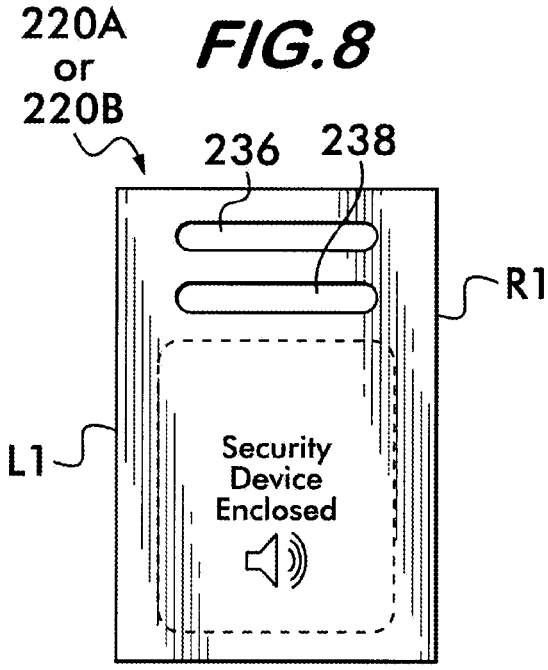
FIG. 8 is plan view of the second security tag/label or the third security tag/label having a pair of vertically-adjacent apertures.
Figure 9:
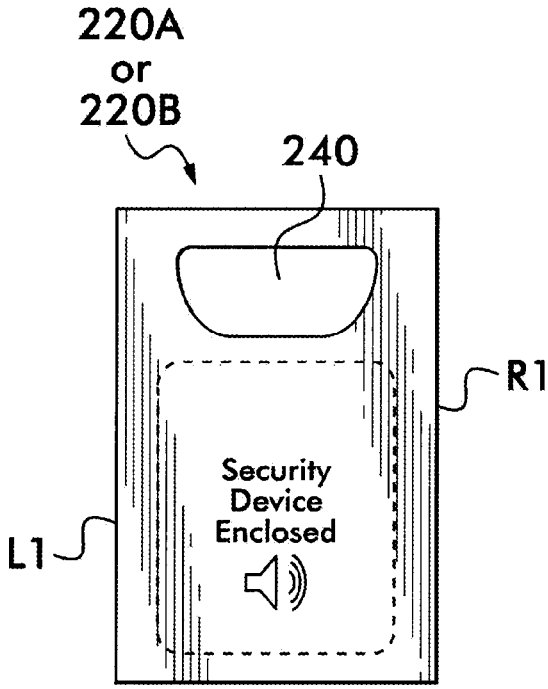
FIG. 9 is a plan view of the second security tag/label or the third security tag/label having another version of a single aperture.
Figure 10:
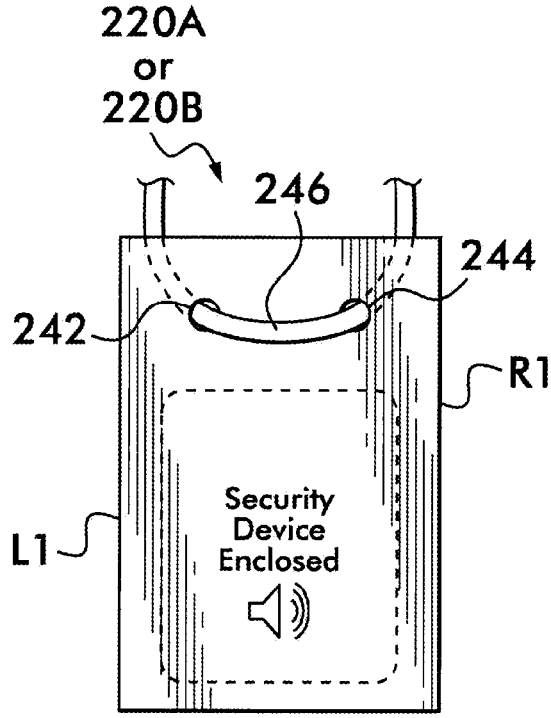
FIG. 10 is a plan view of the second security tag/label or the third security tag/label having a pair of horizontally-adjacent apertures.

FIGS. 8-10 show the security label 220A with different aperture configurations such as: FIG. 8 depicts the security label 220A with a pair of vertically-adjacent apertures 236 and 238. FIG. 9 depicts the security label 220A with a single aperture 240. FIG. 10 depicts the security label 220A with a pair of horizontally-adjacent apertures 242 and 244. Thus, as with the security label 220, a portion (e.g., belt loop, brassiere strap, etc.) of the garment (not shown) may be passed through any of these different aperture configurations as discussed previously with respect to the security label 220 prior to the garment's completion during assembly.

Alternatively, by way of example only, FIG. 10 also shows a lanyard or tether 246 passed through the apertures 242/244 for coupling to the garment (not shown). Thus, it should be understood that not only may a portion 12 of the garment be passed through the aperture configurations of the security labels 220 and 220A, but an external lanyard or tether 246 may be positioned through any of these aperture configurations and the lanyard or tether 246 is then looped or otherwise coupled to the garment (not shown). The lanyard 246 may comprise a string, cord, wire, tube, ribbon or other lanyard/tether configuration that is fed through the different aperture configurations and then coupled to the garment. It is preferred that the lanyard/tether 246 comprise ends (not shown) that are permanently closed once the lanyard 246 is coupled to the garment.

Other variations 220B of the security label or tag include the use of a single pliable material or carrier 222C (FIG. 12) that is folded only once, e.g., at a bottom fold 231, and wherein the free ends are fixedly secured together (e.g., bonded, by being sewn or by hot crimping, etc.) and whereby an aperture (or apertures) are formed at the secured ends of the folded pliable material, as shown most clearly in FIGS. 12, 14, 16 and 18. As discussed previously with the two layer configuration 220A, the slots may be pre-formed in the respective free ends of the pliable material 222C and then aligned at which time the ends are fixedly secured together; alternatively, the ends may first be fixedly secured together and then the aperture(s) formed therein.

Figure 11:
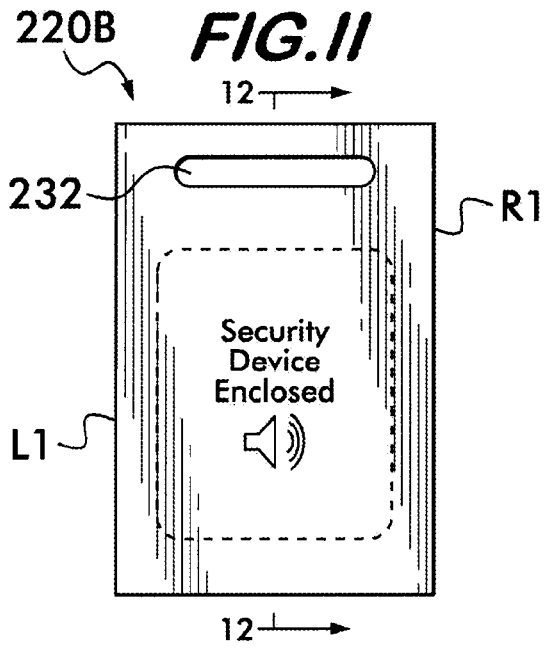
FIG. 11 is also a plan view of a third security tag/label having a single aperture.
Figure 12:
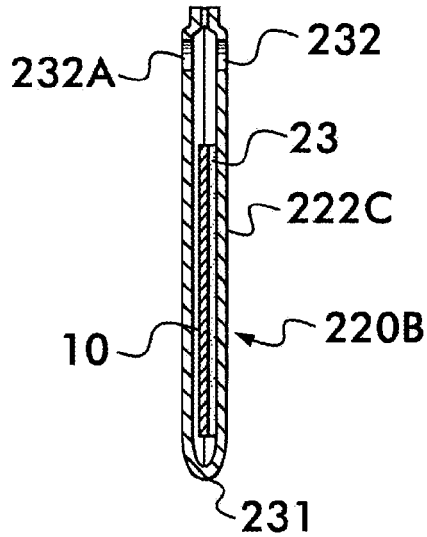
FIG. 12 is a side cross-sectional view of the third security tag/label of FIG. 11.
Figure 13:
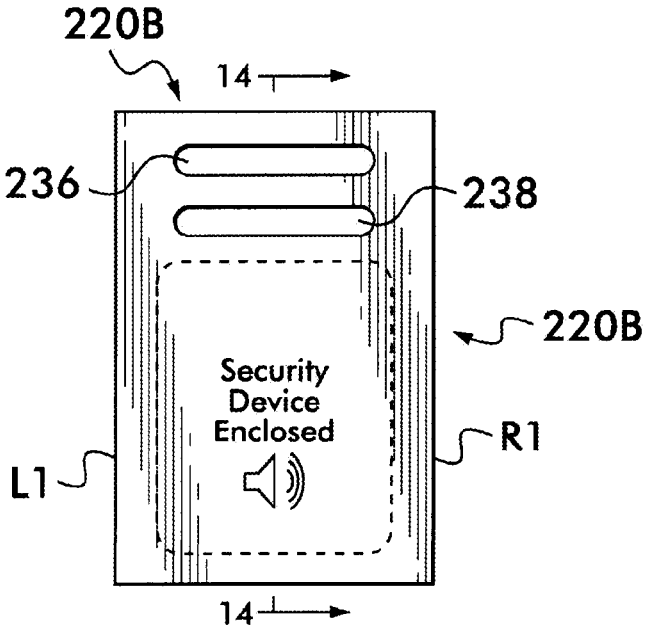
FIG. 13 is also a plan view of the third security tag/label having a pair of vertically-adjacent apertures.
Figure 14:
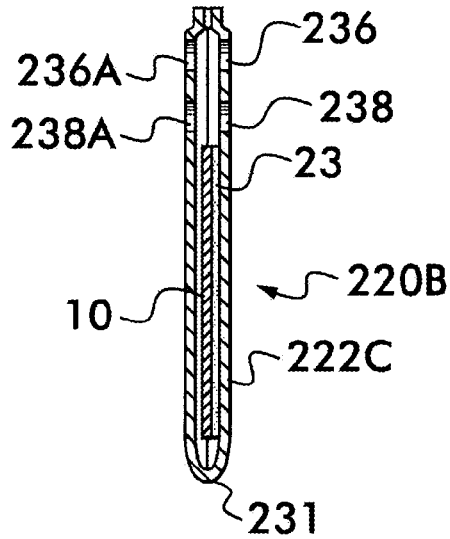
FIG. 14 is a side cross-sectional view of the third security tag/label of FIG. 13.

For example, FIGS. 11-18 depict the security label 220B having a single bottom fold 231 but with different configurations of apertures. FIGS. 11-12 depict an aperture 232 formed by the alignment of slots 232 and 232A being aligned to form a single aperture through which a portion 12 of a garment (or a lanyard/tether 246) may pass; FIGS. 13-14 depict the security label 220B using a pair of vertically-adjacent apertures 236/238 formed by the alignment of slots 236/236A and 238/238A; FIGS. 15-18 depict the security label 220B using a pair of horizontally-adjacent apertures 240/242 formed by or corresponding slots, only two of which 240/240A are shown in FIG. 16; FIG. 18 shows the lanyard or tether 246 (by way of example only) passing through these horizontally-adjacent apertures. FIG. 17 also shows end couplings 247A and 247B for fixedly securing the lanyard/tether 246 ends together around the portion of the garment.

FIGS. 17-18 also depict a lanyard 246 comprising a clear plastic tube which is filled with a colorant (e.g., ink, dye, any substance that leaves a colored mark when released from the tube, etc.) to deter tampering. Upon a valid purchase at the POS, the lanyard 246 and the invention 220A or 220B can be separated from the garment safely by a tool (not shown) that: (1) compresses the tube to safely rupture the tube; (2) safely evacuates the colorant from within the tube; and (3) crimps/melts the rupture closed.

It should be understood that FIG. 17 represents the broad concept of the present invention wherein any of the security labels/tags described in this Specification can use a lanyard/tether that can be looped around any portion of a garment and then closed on itself. Thus, the end couplings 247A and 247B are meant to represent any and all types of couplings known in the art for securing the ends of the lanyard/tether 246 together and includes overlapping the ends (e.g., such as that shown by 112A/112B in FIG. 31) and securing them together.

In view of the foregoing, it should be understood that these different aperture configurations can be used with regard to the security label 220A where two distinct layers 222A and 222B are used, rather than the single folded layer 222C. Thus, FIGS. 7-10 are referenced as comprising 220A or 220B. It should also be understood that these aperture configurations are by way of example only, and that any variation of one or several apertures are within the broadest scope of this invention. Moreover, the aperture or apertures can take the form of slots or openings of numerous sizes and shapes and configurations.

As with the previous security labels 220 and 220A, the side edges L1 and R1 of the invention 220B are bonded or otherwise closed.

As discussed previously with the security label 220A, closure of the top edge T1 (as well as the side edges L1 and R1) may be accomplished in a variety of ways, e.g., bonding.

An alternative to using different aperture configurations for permitting a portion of the garment or a lanyard/tether to pass through the aperture(s) and then coupling the free end of the portion, or the lanyard/tether, to the garment, is via a coupling 248 as shown in FIGS. 19-23. Thus, it should be understood that using the two layer (222A and 222B) configuration of the security label 220A, or the single layer 222C of the security label 220B, with the coupling 248, the different aperture configurations can be omitted. Therefore, where this coupling 248 is used in the present invention, the security label 220C is referenced.

It should be further noted that the coupling 248 is shown by way of example only and the scope of the invention is not limited to that shown.

In particular, as shown most clearly in FIGS. 19-20, the coupling 248 comprises a female receptacle 250 that is secured at the free ends of the single layer 222C (or at the top portion of the two distinct layers 222A/222B) to form the top closure of the security label 220C. The female receptacle 250 receives two male members 252A and 252B that form the two ends of a lanyard or tether 254. The female receptacle 252 comprises a flexible material (e.g., plastic) that includes a pair of sidewalls 250A and 250B that are secured (e.g., an adhesive 251, etc.) to the free ends of the single layer 222C (or to the two distinct layers 222A/222B). The receptacle 251 also comprises top 250C and bottom 250D surfaces which include a plurality of aligned apertures A. FIG. 20 shows one of the male members 252B passed through two aligned apertures A1 and A2 in the top 250C and bottom 250D surfaces respectively. The use of the plurality of aligned apertures A permits the merchant to adjust the size of the loop formed by the lanyard/tether 254 and thereby change the overall appearance and presentation of the invention 220C when coupled to the garment. Each male member 252A and 252B comprise a plurality of teeth T that are used to lock against the underside of the top 250C and bottom 250D surfaces of the female receptacle 250. The plurality of teeth T again permit the merchant to establish the size of the loop formed by lanyard/tether 254. Although not shown, it is within the broadest scope of the present invention to include corresponding teeth or protrusions or cavities on the underside of the top surface 250C and bottom surface 250D to engage or mate with the teeth T on the male members 252A and 252B. As can also be seen in FIGS. 19-20, as the male members 252A and 252B are pushed farther down into the security label 220C, they provide a support along the side edges L1 and R1 of the security label 220C but without distorting or bulging the pliable material 222C (or materials 222A/222B). In use, the merchant would secure one of the male members 252A into a pair of aligned apertures A, loop the remaining free end of the lanyard/tether 254 around a portion of the garment and then secure the other male member 252B (or vice versa) into another set of aligned apertures A, thereby securing the security label 220C to the garment (not shown).

Figure 21:
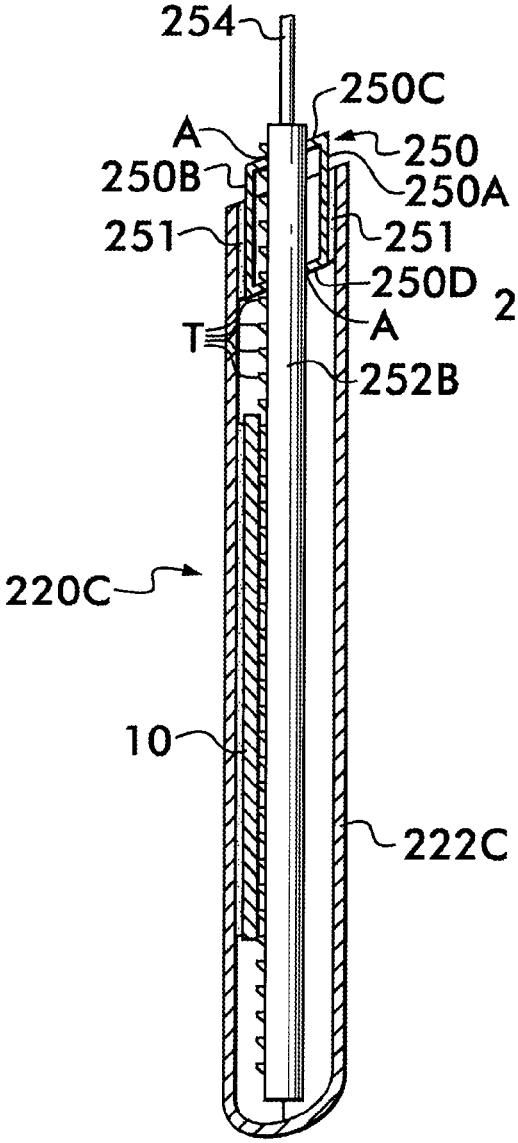
FIG. 21 is an enlarged cross-sectional view similar to FIG. 20 but shown as a male member is inserted in the female receptacle, temporarily distorted due to its flexible composition.

By way of example only, FIG. 21 depicts the flexible nature of the female receptacle 250 as pressure is applied to insert the male member 252A therethrough. In particular, when the male member 252A is passed through the aligned apertures A, the female receptacle 250 is momentarily distorted into a rhomboid shape.

Figure 22:
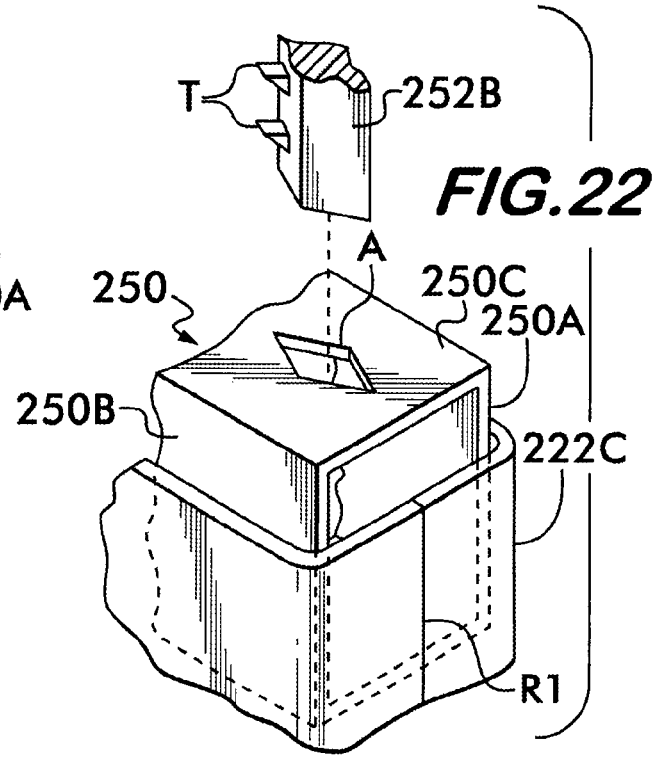
FIG. 22 is an enlarged partial view of the distal end of a male member of a lanyard/tether having a diamond cross-section about to be inserted into a corresponding aperture in the female receptacle.
Figure 23:
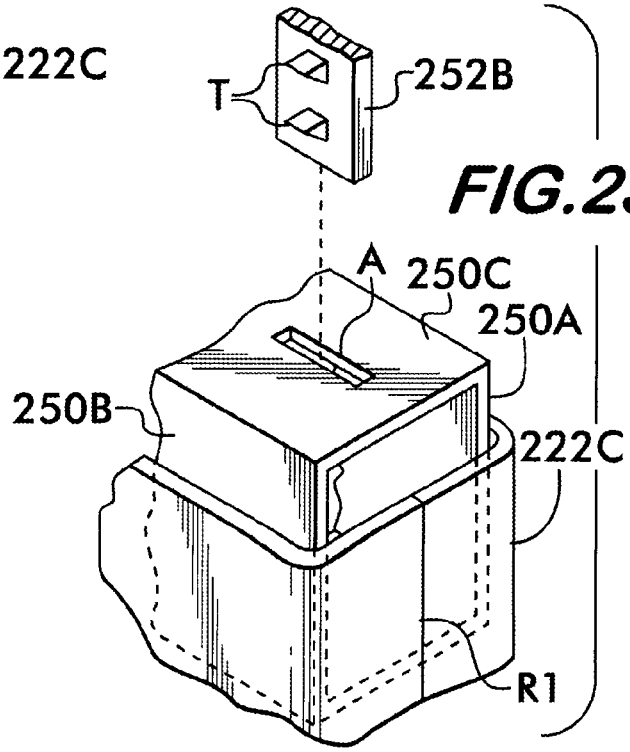
FIG. 23 is an enlarged partial view of the distal end of a male member of a lanyard/tether having a "slit-shaped" cross-section about to be inserted into a corresponding aperture in the female receptacle.

FIGS. 22-23 depict other cross-sectional shapes for the apertures A of the female receptacles as well as the corresponding male members 252A/252B. In particular, FIG. 22 shows a rhomboid or diamond-shaped cross-sectional form for the apertures A and a corresponding cross-sectional shape of the male member 252B (it being understood that the male member 252A and its corresponding female receptacle apertures correspond accordingly). Similarly, FIG. 23 shows a "slit-shaped" male member 252B that can pass through a corresponding "slit-shaped" aperture A in the female receptacle 250 (it being understood that the male member 252A and its corresponding female receptacle apertures correspond accordingly). Thus, it is within the broadest scope of the present invention to include an unlimited number of cross-sectional shapes and sizes for the female receptacle apertures A and the corresponding male member cross-sections.

FIGS. 24-26 depict various lanyard/tether 254 configurations for use with the coupling 248. In FIG. 24, the lanyard/tether 254A comprises the male members having upper portions 256A and 256B that include the teeth T with reduced diameter (or reduced size) shank portions 258A and 258B. Thus, during use, since the upper portions 258A/258B function to lock the lanyard/tether 254A within the female receptacle 250, the teeth T are confined to those upper portions. This permits the shank portions 258A/258B to be reduced in size and thereby avoid distorting or bulging the pliable material 222C (or materials 222A/222B) of the security label 220C. FIG. 25 depicts a similar lanyard/tether 254B but with further reduced-sized shank portions 260A and 260B. In both configurations 254A and 254B, the lanyards/tethers comprise distinct parts. In contrast, FIG. 26 depicts an integrated tether design whereby the lanyard/tether 254C comprises one material shaped to form the male member portions 260A/260B and the corresponding shank portions 264A/264B. Thus, the lanyard/tether 254C may be an extruded element whereby the male members 262A/262B and the lanyard/tether portion 254 that ultimately loops around the garment (not shown) are of the same size while the end portions (which form the shank portions 264A/264B) are of a reduced size.

It should be understood that any of these alternative lanyard/tether configurations of FIGS. 24-26 may comprise the cross-sectional designs or FIGS. 19-23 or other cross-sectional designs.

Figure 32:
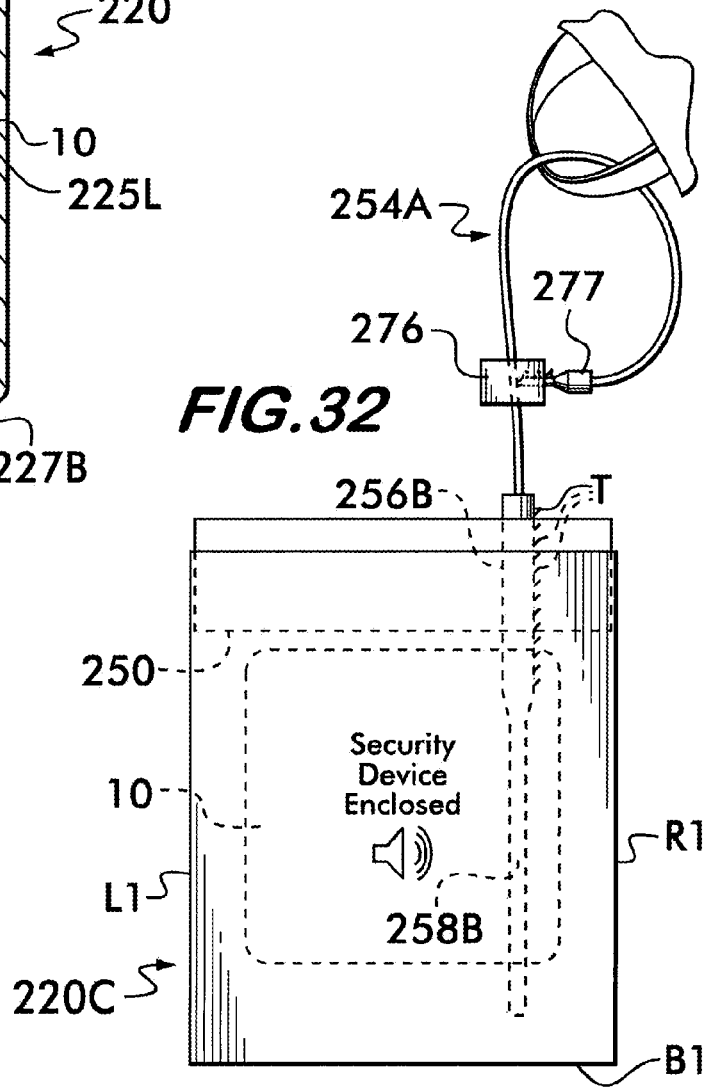
FIG. 32 is similar to the invention of FIGS. 19-26 but where one end of the lanyard couples to a lanyard coupling at the security tag and the other end of the lanyard couples to itself after being looped around a finished portion of a garment.

An alternative to the use of a lanyard whose two ends are secured within the lanyard coupling 248 is shown in FIG. 32. In particular, only one end of the lanyard 256 is secured within the female receptacle 250. The other end of the lanyard 254 comprises a small male member 277. In addition, the lanyard 254 itself comprises a female receptacle 276 for receiving the male member 277. Thus, one end of the lanyard 254 can be looped around a finished portion of a garment (e.g., see "garment loop) and then connected to itself via elements 276/277 and the other end of the lanyard 254 can be secured within the female receptacle 250, thereby coupling the security label 220C to the garment. FIG. 32 shows the male member 277 being partially inserted into the female receptacle 276, to more clearly show any teeth (or equivalent mechanisms) for locking the male member 277 into the female receptacle 277.

It should also be understood that the lanyard configuration of FIGS. 19-26 may comprise colorant-filled lanyards and wherein the male member extensions that reside within the pliable material are also filled with a colorant (e.g., ink, dye, any substance that leaves a colored mark when released from the lanyard, etc.) when the male members are secured within the lanyard coupling. As a result, if a would-thief were to cut the lanyard 254 this would release the colorant; alternatively, if the would-be thief were to cut through the pliable material itself, this would rupture the male member extension also releasing the colorant. By way of example only, it is within the broadest scope of the present invention to have the extension portions 260A and 260B in FIG. 25 comprise a single hollow element with the lanyard 254 which is filled with a colorant. The upper portions 256A and 256B can be slid over the respective ends 260A and 260B forming a lanyard assembly. The male members can then be engaged within the lanyard coupling 250 as discussed previously.

Figure 27:
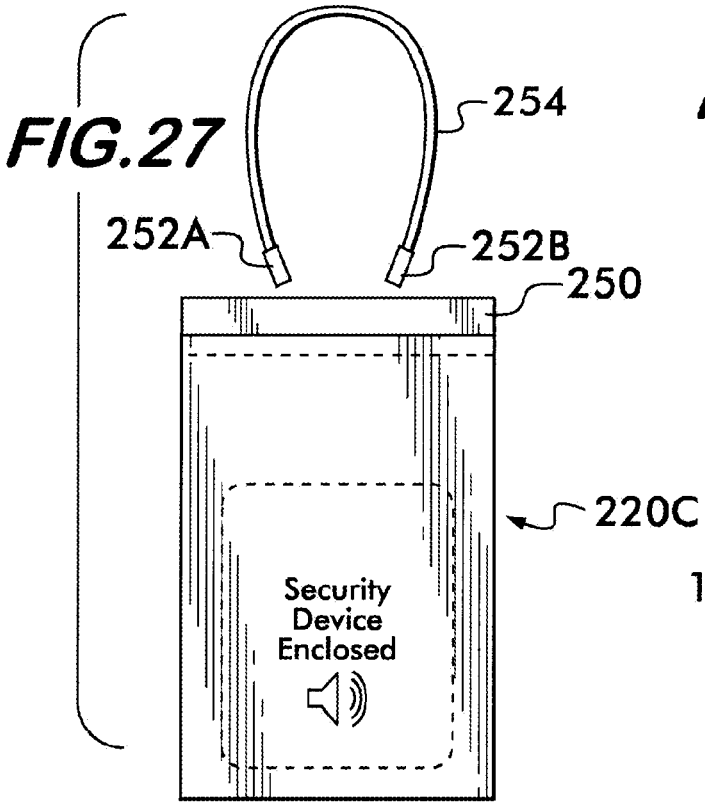
FIG. 27 depicts a functional diagram of the third security tag/label using the coupling of FIGS. 19-26.
Figure 27A:
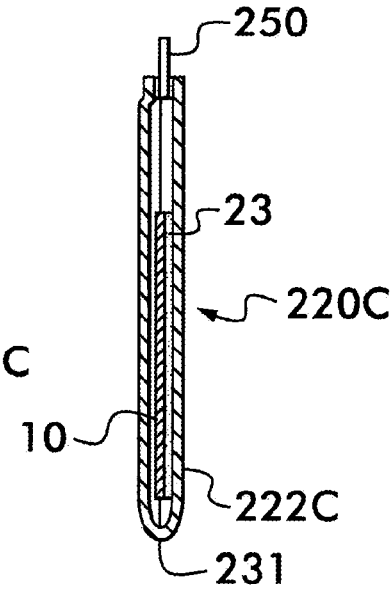
FIG. 27A is a side cross-sectional view of the third security tag/label using the coupling of FIGS. 19-26.

FIGS. 27 and 27A depict the security label 220C in a general configuration using the coupling 248 and the male member/female receptacle components.

Other variations of the lanyard/tether configuration include a lanyard of a woven ribbon including a metal material woven into the ribbon for the purpose of making it more difficult to remove the lanyard without a proper tool. Another variation involves a carrier comprising a pliable material wherein the lanyard is a separate item which includes a meltable material attached thereto. The lanyard is then dispensed onto or into the carrier using a tool. The tool then melts the carrier to the melt material on the lanyard.

Figure 28:
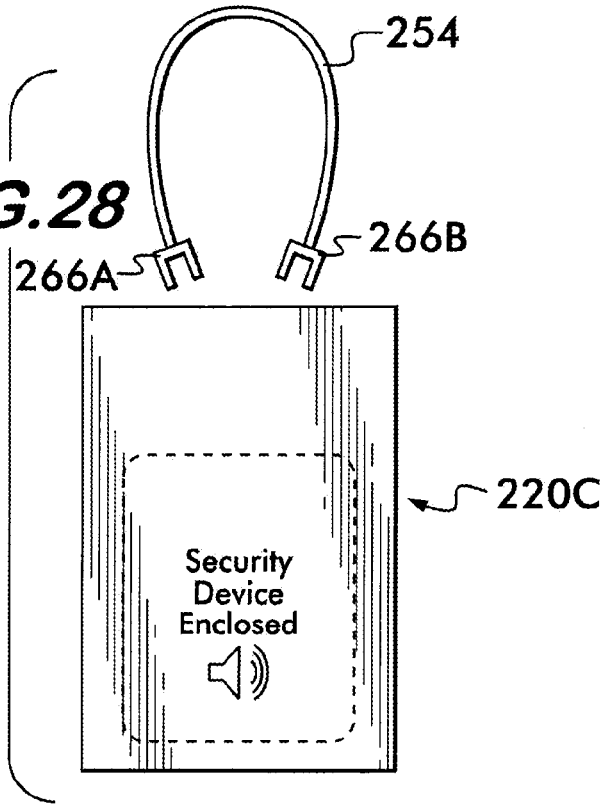
FIG. 28 depicts another variation of a lanyard/tether coupling mechanism for the third security tag/label which includes an "all in one latch" mechanism in the lanyard for capturing or seizing an edge of the carrier.
Figure 28A:
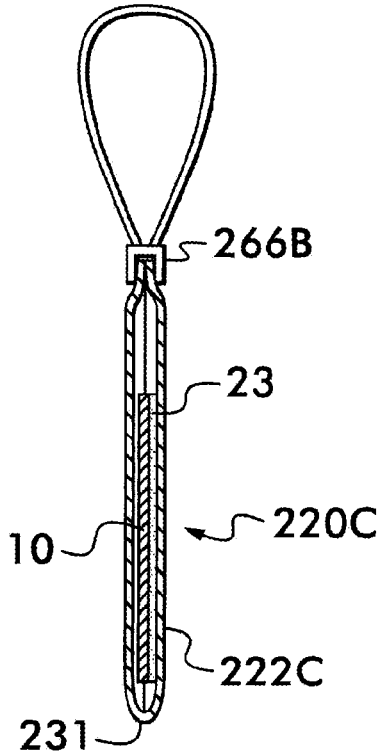
FIG. 28A is a side cross-sectional view of the variation of the lanyard/tether coupling mechanism of the third security element of FIG. 28.

FIGS. 28-28A depict another version of the lanyard/tether coupling mechanism. In particular, the lanyard includes ends 266A and 266B that contain an "all in one latch" that capture or seize the top edge of the security label 220C.

Figure 29:
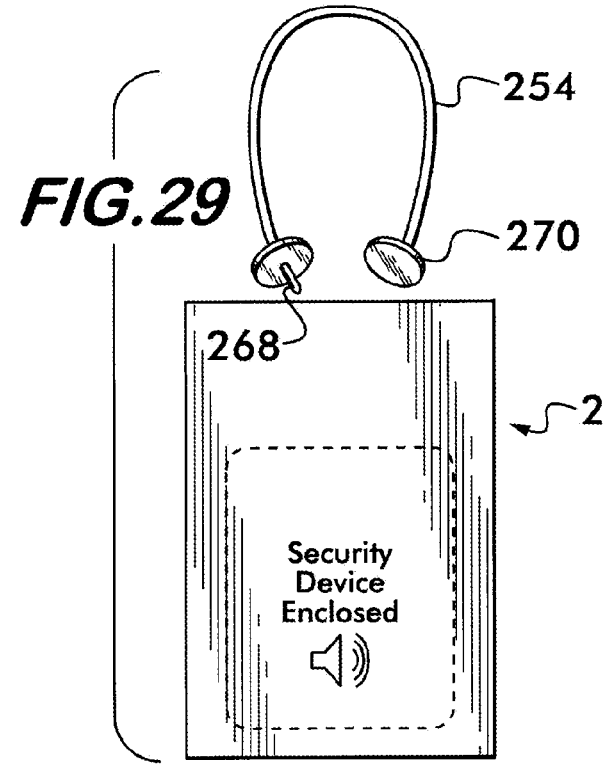
FIG. 29 depicts even a further variation of the lanyard/tether coupling mechanism of the third security tag/label whereby the "all in one latch mechanism" comprises a pin on one end of the lanyard and a pin receptacle on the other end of the lanyard and whereby the pin passes through the carrier and is captured in the pin receptacle.
Figure 29A:
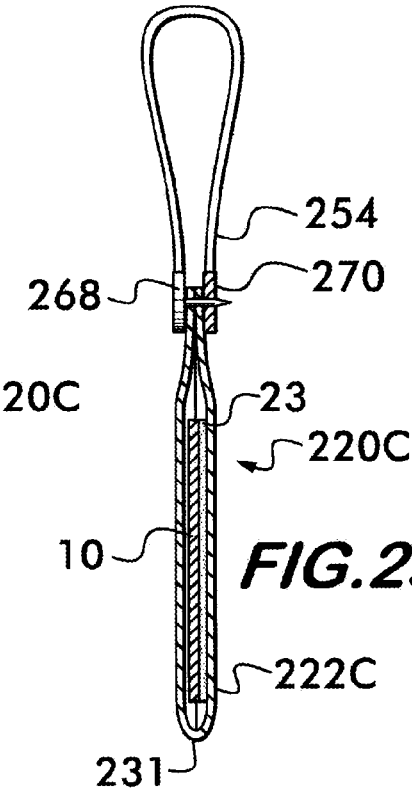
FIG. 29A is a side cross-sectional view of the further variation of the lanyard/tether coupling mechanism of the third security tag/label of FIG. 29.
Figure 30A:
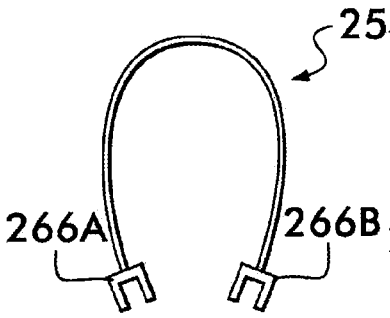
FIGS. 30A-30F depict lanyards having different compositions that can be used in any of the second or third security tag/label configurations.
Figure 30B:
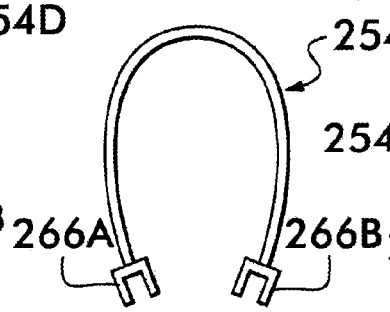
Figure 30C:
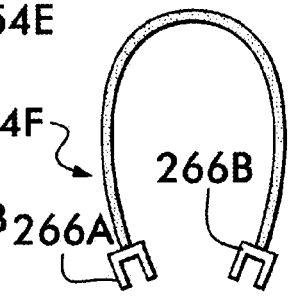
Figure 30D:
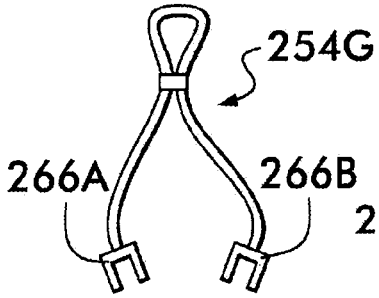
Figure 30E:
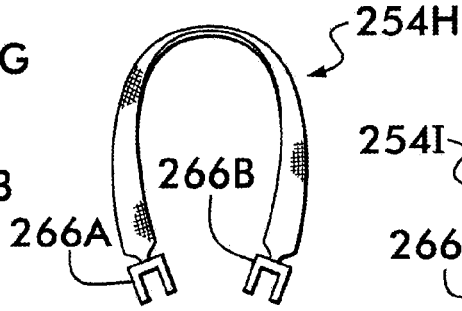
Figure 30F:
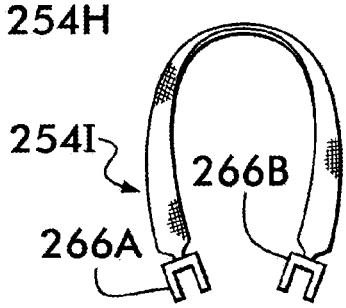

FIG. 29-29A depict even a further version of the lanyard/tether coupling mechanism. In particular, the lanyard includes a variation to the "all in one latch" whereby a pin 268 is present on one end of the lanyard 524 and a pin receptacle 270 for receiving the pin 268 is located on the other end of the lanyard 524. As shown most clearly in FIG. 29A, the pin 268 either passes through an aperture in the carrier 222C or it pierces the carrier 222C and then is captured in the receptacle 270.

It should be understood that although the various lanyard/tether configurations of FIGS. 27-29A are shown in use with the third security tag 220C, this is by way of example only;

these various lanyard/tether configurations can also be used with the second security tag 220B.

It should be understood that the male/female latching mechanisms described herein are by way of example only and encompass various kinds of such latches, not just those described herein.

FIGS. 30A-30F provide variations in the composition of the lanyard/tether 524 itself. It should be understood that any one of these lanyard/tethers could be used with all of the coupling mechanisms for the second and third security tags/labels described previously. Thus, the lanyard 254D of FIG. 30A comprises a wire lanyard that requires a more specialized tool to remove it from the garment. The lanyard 254E comprises a plastic lanyard that requires a more specialized tool to remove it from the garment. The lanyard 254F (similar to the lanyard described earlier with respect to FIG. 17) comprises a clear plastic tube filled with a colorant (e.g., ink, dye, any substance that leaves a colored mark when released from the tube, etc.) therein. The lanyard 254G comprises either a clear plastic tube, wire or plastic and has a locked cinching mechanism. The lanyard 254H is an elegant woven ribbon lanyard. The lanyard 254I is an elegant woven ribbon lanyard with an interwoven wire. The lanyard ends 266A and 266B in these lanyard/tether configurations of FIGS. 30A-30F are shown by way of example only.

Another variation of this embodiment involves a lanyard filled with a colorant (e.g., ink, dye, any substance that leaves a colored mark when released from the lanyard, etc.) and wherein the lanyard ends are disposed within the pliable material and the lanyard is then secured to the pliable material. Thus, if a would-be thief attempts to cut through the lanyard, the colorant will be dispersed. Alternatively, if the would-be thief decides to cut through the security label itself, one or both of the lanyard ends will be severed, again dispersing the colorant. By way of example only, FIGS. 33-34 show such a variation. In particular, lanyard 254 comprises an exemplary latch mechanism for capturing or seizing an edge (e.g., the top edge T1) of the security label 220C. In particular, a colorant-filled lanyard 254 has respective latches 278A and 278B secured thereto. Stops 280A and 280B are provided to prevent the lanyard 254 from being pulled out of the latches 278A and 278B. During formation of the security tag 220C as well as coupling to the garment (not shown), the ends 254J and 254K of the lanyard 254 are looped around the garment portion (not shown) then disposed inside the pliable material or carrier through an open edge (e.g., top edge T1). This edge of the tag can be bonded or sealed closed as discussed previously and the latches 278A and 278B can be fixedly coupled to this edge (e.g., top edge T1) of the security label 220C. Thus, if a would-be thief attempts to cut through the lanyard 254, the colorant will be dispersed. Alternatively, if the would-be thief decides to cut through the security label 220C itself, either or both of the lanyard ends 254J/254K will be severed, again dispersing the colorant. However, it should be understood that the particular embodiment portrayed in FIGS. 33-34 is by way of example only and that there may be several ways to accomplish securing the colorant-filled lanyard to the pliable material while positioning a portion of the lanyard within the pliable material.

It should be understood that in the hot crimping process involves the use of a crimp tool that utilizes heat to create localized heat (rather than ambient heat) to avoid damaging the security element 10. The hot crimp process melts the pliable material or carrier to form a bond long the sides L1/R1, and/or along the top edge where the single layer 222C pliable material is used, or along all of the edges where the two layer configuration 222A and 222B is used. A heat-activated adhesive or acrylic adhesive may be used therewith. Joining the folds F1 and F2 may also use a similar process. The width of this hot crimp seam may comprise 1/16" or 1/32" by way of example only. Joining the folds F1 and F2 may also use a similar process.

It is within the broadest scope of the present invention to include the creation of a "pouch" or "pocket" with the pliable material itself without the use of folds (e.g., FIGS. 1-4, or 12 or 14) or sandwiching (e.g., FIG. 6). This further variation for forming a "pouch" or "pocket" within a pliable material itself, is to form a "woven cavity". In particular, using a process known as "tube weaving", the edges L1, R1, B1 (for example, FIG. 5) are woven edges with an open edge T1 which form an integral pouch or pocket for permitting depositing the security element 10 therein. The open edge T1 is then closed using a heat crimp, sewing or adhesive.

In all of the embodiments discussed previously, the security element 10 may be attached to the pliable material or carrier. This may be accomplished in a variety of ways but the most preferred method is an adhesive, typically, using hot melt rubber-based adhesives. These adhesives are used for the application of the security element to the pliable material. Alternatively, the security element may simply be free-floating within the pliable material.

Different embodiments and/or variations may comprise different colors or material constructions to have the desired appearance or may carry desired information such as but not limited to instructions to remove the item due to the nature of the device, e.g., "RFID device enclosed, remove if desired", or "RFID device enclosed—if this labeling is removed the item can not be returned." Other instructions are also intended for this packaging.

The security labels/tags of the present invention may also be constructed with additional material to enhance the bonding characteristics when the folds are fastened together either to enhance the crimping or hot melt properties or to strengthen the label to reduce the ease in which the invention can be removed from the item to which it is attached.

The present invention provides a means to attach a non-invasive tag/label which holds a security device to an item or items so that it may be attached in an efficient manner, not be a permanent fixture of the item or items, carry instructions or brand information, attached at the source of manufacture, attached at distribution, attached at retail or at any location along the supply chain. The present invention is intended to be removed from the item by the consumer.

While the invention has been described in detail and with reference to specific examples thereof, it will be apparent to one skilled in the art that various changes and modifications can be made therein without departing from the spirit and scope thereof.

What is claimed is:

1. A security tag for coupling to an item, said security tag comprising:

at least one security element that responds to a magnetic or an electromagnetic field of a particular frequency or frequencies; and a pliable material in which said security element is concealed and wherein said pliable material comprises at least one aperture, said at least one aperture receiving a portion of the item, during item assembly, or receiving a lanyard, for coupling to the item.

2. The security tag of claim 1 wherein said pliable material comprises a single layer of pliable material having a plurality of folds and fold lines, said folds having respective slots and said fold lines having at least one slit therein, said folds overlapping and aligning said slots forming said at least one aperture.

3. The security tag of claim 2 wherein said folds and slots are disposed on a common side of said security tag.

4. The security tag of claim 1 wherein said pliable material is a woven fabric.

5. The security tag of claim 1 wherein said pliable material is plastic.

6. The security tag of claim 1 wherein said pliable material comprises two layers, said layers sandwiching said security element therebetween and wherein said two layers are secured to each other.

7. The security tag of claim 6 wherein said at least one aperture comprises a first aperture and a second aperture, said first aperture located adjacent a first end of said tag and said second aperture located adjacent a second edge, said second edge being opposite said first edge.

8. The security tag of claim 6 wherein said at least one aperture comprises a pair of apertures located adjacent each other.

9. The security tag of claim 6 wherein said pair of apertures are vertically oriented with respect to each other.

10. The security tag of claim 6 wherein said pair of apertures are horizontally oriented with respect to each other.

11. The security tag of claim 1 wherein pliable material comprises a single layer of pliable material having a single fold, said pliable material having a pair of aligned ends that are fixedly secured together.

12. The security tag of claim 11 wherein said at least one aperture comprises a first aperture and a second aperture, said first aperture located adjacent a first end of said tag and said second aperture located adjacent a second edge, said second edge being opposite said first edge.

13. The security tag of claim 11 wherein said at least one aperture comprises a pair of apertures located adjacent each other.

14. The security tag of claim 11 wherein said pair of apertures are vertically oriented with respect to each other.

15. The security tag of claim 11 wherein said pair of apertures are horizontally oriented with respect to each other.

16. The security tag of claim 11 further comprising said lanyard and wherein said lanyard comprises a wire.

17. The security tag of claim 11 further comprising said lanyard and wherein said lanyard comprises plastic.

18. The security tag of claim 11 further comprising said lanyard and wherein said lanyard comprises a cinching mechanism.

19. The security tag of claim 11 further comprising said lanyard and wherein said lanyard comprises a woven ribbon.

20. The security tag of claim 11 further comprising said lanyard and wherein said lanyard comprises a woven ribbon including an interwoven wire.

21. The security tag of claim 1 further comprising said lanyard and wherein said lanyard comprises a tube comprising a colorant therein, said tube having ends that are secured together.

22. The security tag of claim 21 wherein said liquid comprises an ink.

23. The security tag of claim 1 wherein said pliable material comprises a woven cavity into which said security element is positioned.

24. A security tag for coupling to an item, said security tag comprising:

at least one security element that responds to a magnetic or an electromagnetic field of a particular frequency or frequencies;

a pliable material in which said security element is concealed; and a lanyard comprising a pair of ends, at least one of which secures to at least one edge of said pliable material.

25. The security tag of claim 24 wherein said pliable material is a woven fabric.

26. The security tag of claim 24 wherein said pliable material is plastic.

27. The security tag of claim 24 wherein said at least one edge of said pliable material comprises a pair of aligned ends, said aligned ends being fixedly secured to a lanyard coupling; and wherein said lanyard comprises a pair of ends each having a mating coupling for securing to said lanyard coupling.

28. The security tag of claim 27 wherein said lanyard coupling comprises a flexible element having at least two pairs of aligned apertures and wherein each of said mating couplings passes through a respective pair of aligned apertures.

29. The security tag of claim 28 wherein each of said mating couplings comprises a plurality of teeth along a length of each of said mating couplings.

30. The security tag of claim 24 wherein said at least one edge of said pliable material comprises a pair of aligned ends, said aligned ends being fixedly secured to a lanyard coupling; and wherein said lanyard comprises a pair of ends, one of said ends having a mating coupling for securing to said lanyard coupling and the other of said ends having a second mating coupling for securing to a receptacle that is associated with said lanyard.

31. The security tag of claim 24 wherein said pair of ends that secure to at least one edge of said pliable material comprise a latch that captures or seizes said at least one edge of said pliable material.

32. The security tag of claim 24 wherein pair of ends of said lanyard that secure to at least one edge of said pliable material comprises a pin and a receptacle, said pin piercing said pair of aligned ends and being captured within said receptacle.

33. The security tag of claim 24 wherein said pliable material comprises a woven cavity into which said security element is positioned.

34. A security tag for coupling to an item, said security tag comprising:

at least one security element that responds to a magnetic or an electromagnetic field of a particular frequency or frequencies;

a pliable material in which said security element is enclosed; and a lanyard, filled with a colorant, having ends that are enclosed within said pliable material, said lanyard being coupled to said pliable material.

35. The security tag of claim 34 further comprising a pair of latches, secured at distinct locations away from respective ends of said lanyard, and wherein said latches capture at least one edge of said pliable material.

36. The security tag of claim 34 wherein said colorant is ink.

37. A method for coupling a security label to an item without piercing or adhering said security label to the item, said method comprises:

concealing a security element within a pliable material, said security element being responsive to a magnetic or an electromagnetic field of a particular frequency or frequencies;

providing at least one aperture within said pliable material;

feeding a portion of the item through said at least one aperture during assembly of said item; and completing said item by securing said portion to the item.

38. The method of claim 37 wherein said step of concealing a security element within a pliable material comprises:

forming a plurality of slots and slits in portions of a single layer of pliable material;

positioning said security element on said single layer of pliable material;

folding said single layer of material around said security element and where said slits are present to form overlapping folds fixedly securing together edges that are transverse to said folds; and fixedly securing said overlapping folds together.

39. The method of claim 38 wherein said step of fixedly securing said overlapping folds together precedes said step of fixedly securing together edges that are transverse to said folds.

40. The method of claim 37 wherein said step of concealing a security element within a pliable material comprises tube weaving a woven cavity within said pliable material and disposing said security element within said woven cavity.

41. A method for coupling a security label to an item without piercing or adhering said security label to the item, said method comprises:

concealing a security element within a pliable material, said security element being responsive to a magnetic or an electromagnetic field of a particular frequency or frequencies;

providing at least one aperture within said pliable material;

passing one end of a lanyard through said at least one aperture and around a portion of the item; and securing said one end of said lanyard to another end of said lanyard to couple said security label to the item.

42. The method of claim 41 wherein said step of concealing a security element within a pliable material comprises tube weaving a woven cavity within said pliable material and disposing said security element within said woven cavity.

43. A method for coupling a security label to an item without piercing or adhering said security label to the item, said method comprises:

concealing a security element within a pliable material, said security element being responsive to a magnetic or an electromagnetic field of a particular frequency or frequencies;

fixedly securing a lanyard coupling along an edge of said pliable material;

looping a lanyard around a portion of the item; and fixedly securing ends of said lanyard within said lanyard coupling.

44. The method of claim 43 wherein said step of concealing a security element within a pliable material comprises tube weaving a woven cavity within said pliable material and disposing said security element within said woven cavity.

45. A method for coupling a security label to an item without piercing or adhering said security label to the item, said method comprises:

concealing a security element within a pliable material, said security element being responsive to a magnetic or an electromagnetic field of a particular frequency or frequencies;

fixedly securing a lanyard coupling along an edge of said pliable material;

looping a lanyard around a portion of the item; and fixedly securing a first end of said lanyard within said lanyard coupling and securing a second end of said lanyard to said lanyard.

46. The method of claim 45 wherein said step of concealing a security element within a pliable material comprises tube weaving a woven cavity within said pliable material and disposing said security element within said woven cavity.

47. A method for coupling a security label to an item without piercing or adhering said security label to the item, said method comprises:

concealing a security element within a pliable material, said security element being responsive to a magnetic or an electromagnetic field of a particular frequency or frequencies;

looping a lanyard around a portion of the item; and fixedly securing ends of said lanyard to an edge of said pliable material.

48. The method of claim 47 wherein said step of concealing a security element within a pliable material comprises tube weaving a woven cavity within said pliable material and disposing said security element within said woven cavity.

49. A method for coupling a security label to an item without piercing or adhering said security label to the item, said security tag comprising:

concealing a security element within a pliable material, said security element being responsive to a magnetic or an electromagnetic field of a particular frequency or frequencies;

providing a lanyard, filled with a colorant, and disposing ends of said lanyard within said pliable material; and securing said lanyard to said pliable material.

50. The method of claim 49 wherein said step of securing said lanyard to said pliable material comprises securing a pair of latches, positioned at distinct locations away from respective ends of said lanyard, at an edge of said pliable material.

51. The method of claim 49 wherein said step of concealing a security element within a pliable material comprises tube weaving a woven cavity within said pliable material and disposing said security element within said woven cavity.

52. The method of claim 49 wherein said colorant is ink.

* * * * *